US005828996A

United States Patent [19]

Iijima et al.

[11] Patent Number: 5,828,996

[45] Date of Patent: Oct. 27, 1998

[54] APPARATUS AND METHOD FOR ENCODING/DECODING A SPEECH SIGNAL USING ADAPTIVELY CHANGING CODEBOOK VECTORS

[75] Inventors: Kazuyuki Iijima, Saitama; Masayuki Nishiguchi, Kanagawa; Jun Matsumoto, Kanagawa; Shiro Omori, Kanagawa, all of Japan

[73] Assignee: Sony Corporation, Tokyo, Japan

[21] Appl. No.: 736,988

[22] Filed: Oct. 25, 1996

[30] Foreign Application Priority Data

Oct. 26, 1995 [JP] Japan ..... 7-279417

[51] Int. Cl.[6] ..... G10L 7/02

[52] U.S. Cl. ..... 704/220; 704/223; 704/229; 704/219; 704/222

[58] Field of Search ..... 704/225, 200, 704/222, 219, 223, 229, 220

[56] References Cited

U.S. PATENT DOCUMENTS

| | | | |
|---|---|---|---|
| 4,052,568 | 10/1977 | Jankowski | 179/15 |
| 4,545,065 | 10/1985 | Visser | 395/2.32 |
| 4,802,221 | 1/1989 | Jibbe | 395/2.31 |
| 4,969,192 | 11/1990 | Chen et al. | 395/2.31 |
| 5,151,968 | 9/1992 | Tanaka et al. | 395/2 |
| 5,230,036 | 7/1993 | Akamine et al. | 395/2 |
| 5,233,660 | 8/1993 | Chen | 395/2.31 |
| 5,263,119 | 11/1993 | Tanaka et al. | 395/2.32 |
| 5,271,088 | 12/1993 | Bahler | 395/2 |
| 5,323,486 | 6/1994 | Taniguchi et al. | 395/2.31 |
| 5,414,796 | 5/1995 | Jacobs et al. | 395/2.3 |
| 5,491,771 | 2/1996 | Gupta et al. | 395/2.32 |
| 5,524,170 | 6/1996 | Matsuo et al. | 395/2.31 |
| 5,533,133 | 7/1996 | Lamkin et al. | 381/94 |
| 5,553,193 | 9/1996 | Akagiri | 395/2.38 |
| 5,579,433 | 11/1996 | Jarvinen | 395/2.28 |
| 5,651,090 | 7/1997 | Moriya et al. | 395/2.31 |
| 5,675,702 | 10/1997 | Gerson et al. | 395/2.32 |

FOREIGN PATENT DOCUMENTS

| | | | |
|---|---|---|---|
| 0516439 | 12/1992 | European Pat. Off. | G10L 7/04 |
| 0573398 | 12/1993 | European Pat. Off. | G10L 9/14 |
| 0582921 | 2/1994 | European Pat. Off. | G10L 9/14 |

*Primary Examiner*—David R. Hudspeth
*Assistant Examiner*—Vijay B. Chawan
*Attorney, Agent, or Firm*—Jay H. Maioli

[57] ABSTRACT

An encoding apparatus in which an input speech signal is divided into blocks and encoded in units of blocks. The encoding apparatus includes an encoding unit for performing CELP encoding having a noise codebook memory containing having codebook vectors generated by clipping Gaussian noise and codebook vectors obtained by learning using the code vectors generated by clipping the Gaussian noise as initial values. The encoding apparatus enables optimum encoding for a variety of speech configurations.

5 Claims, 14 Drawing Sheets

| | 2kbps | 6kbps |
|---|---|---|
| U/V decision output | 1 bit/ 20 msec | 1 bit/ 20 msec |
| LSP quantization index | 32 bits/ 40 msec | 48 bits/ 40 msec |
| for voiced speech (V) | pitch data 8 bits/ 20 msec | pitch data 8 bits/ 20 msec |
| | Spectral envelope VQ index 15 bits/ 20 msec | Spectral envelope VQ index 87 bits/ 20 msec |
| | shape (for first stage), 5+5 bits/ 20 msec gain, 5 bits/ 20 msec | shape (for first stage), 5+5 bits/ 20 msec gain, 5 bits/ 20 msec index (for second stage), 72 bits/ 20 msec |
| for unvoiced speech (UV) | Time domain VQ index 11 bits/ 10 msec | Time domain VQ index 23 bits/ 5 msec |
| | shape (for first stage), 7 bits / 10 msec gain, 4 bits/ 10 msec | shape for first stage, 9 bits / 5 msec gain, 6 bits/ 5 msec shape for second stage, 5 bits /5 msec gain, 3 bits/ 5msec |
| for voiced speech for unvoiced speech | 40 bits/ 20 msec 39 bits/ 20 msec | 120 bits/ 20 msec 117 bits/ 20 msec |

FIG.15

APPARATUS AND METHOD FOR ENCODING/DECODING A SPEECH SIGNAL USING ADAPTIVELY CHANGING CODEBOOK VECTORS

BACKGROUND OF THE INVENTION

FIELD OF THE INVENTION

This invention relates to a speech encoding method and apparatus in which an input speech signal is divided into blocks and encoded in units of blocks. Descriptions in the related art regarding the bit rate of the encoding data can vary.

There have hitherto been known a variety of encoding methods for encoding an audio signal (including speech and acoustic signals) for compression by exploiting statistical properties of the signal in the time domain and in the frequency domain and using psychoacoustic characteristics of the human ear. The encoding methods may roughly be classified into time-domain encoding, frequency-domain encoding, and analysis/synthesis encoding. Examples of high-efficiency encoding of speech signals include sinusoidal analysis encoding, such as harmonic encoding, multi-band excitation (MBE) encoding, sub-band coding (SBC), linear predictive coding (LPC), discrete cosine transform (DCT), modified DCT (MDCT) and fast Fourier transform (FFT). Other examples of high-efficiency encoding of speech signals include code excited linear prediction (CELP) encoding by optimum vector closed-loop search employing an analysis-by-synthesis method.

In code excited linear prediction encoding, as an example of high-efficiency encoding of the speech signals, the encoding quality is influenced significantly by the properties of the encoded speech signals. For example, there are a variety of configurations of speech such that it is difficult to achieve satisfactory encoding for all of the speech, especially consonants close to the noise level, such as "sa," "shi," "su," "se," and "so," and consonants having sharp rising portions (steep rising consonants) such as "pa," "pi," "pu," "pe," or "po" in Japanese and in English.

SUMMARY OF THE INVENTION

It is therefore an object of the present invention to provide a speech encoding method and apparatus whereby speech of various configurations can be encoded satisfactorily.

The speech encoding method and apparatus of the present invention performs encoding in terms of units of blocks, obtained by dividing the input speech signal on the time axis, and the time-domain waveform of the input speech signal is vector-quantized by a closed loop search of the optimum vector using an analysis-by-synthesis method, in which a codebook for vector quantization is obtained by clipping the Gaussian noise with a plurality of threshold values.

That is, according to the present invention, a code vector obtained by clipping the Gaussian noise with a plurality of different threshold values is used for performing vector quantization in order to cope with various speech configurations.

BRIEF DESCRIPTION OF THE DRAWINGS

FIG. 15 is a table showing output data for different bit rates in the speech signal encoder of the present invention.

DETAILED DESCRIPTION OF THE PREFERRED EMBODIMENTS

Figure 1:
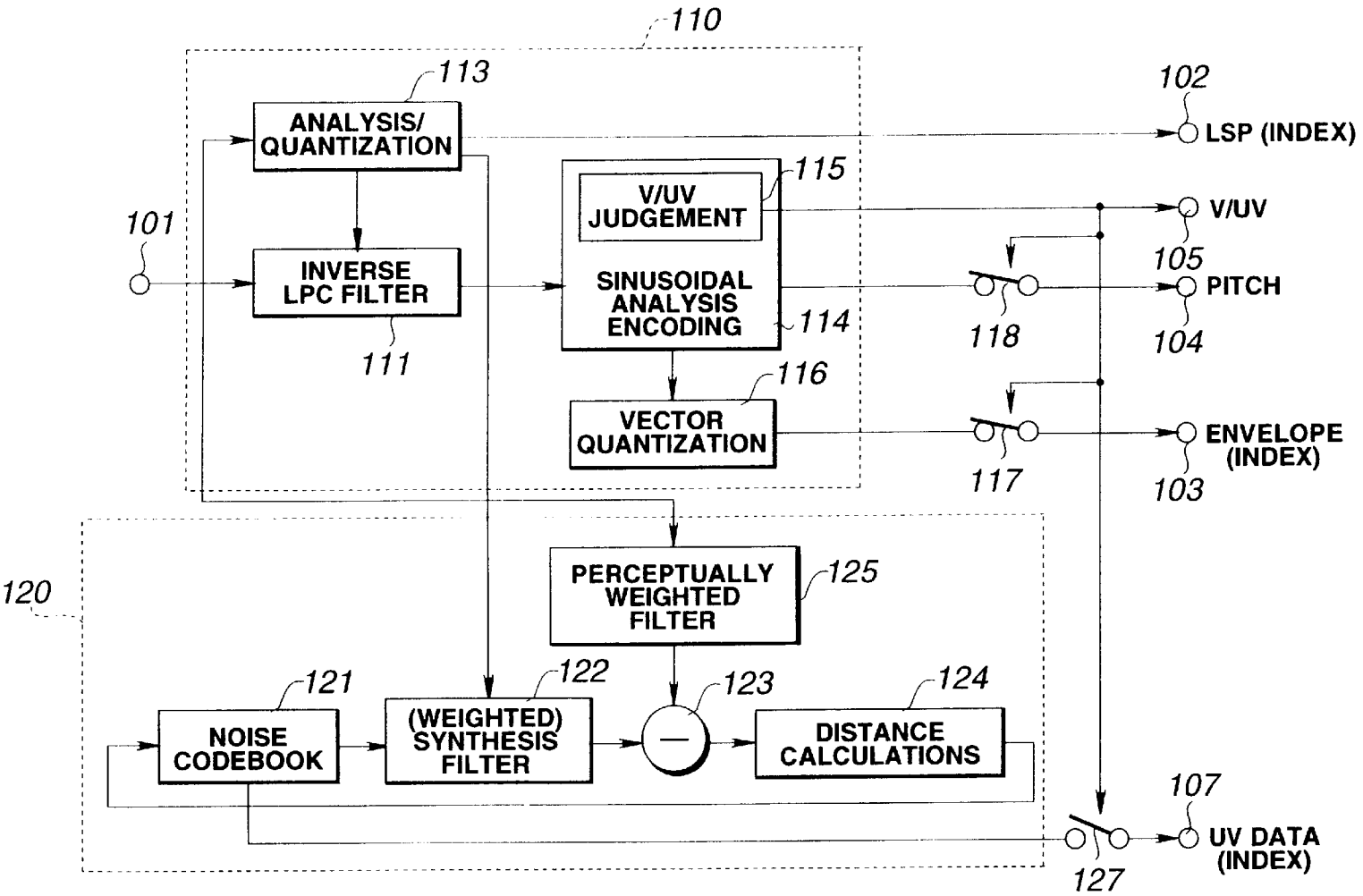
FIG. 1 is a block diagram showing a basic structure of a speech signal encoding method and a speech signal encoding apparatus (encoder) for carrying out the encoding method according to the present invention.

Referring to the drawings, preferred embodiments of the present invention will be explained in detail.

FIG. 1 shows a block diagram of a basic structure of a speech signal encoder for carrying out the speech encoding method according to an embodiment of the present invention. The speech signal encoder includes an inverse LPC filter 111 as means for finding short-term prediction residuals of an input speech signal, and a sinusoidal analytic encoder 114 as means for finding sinusoidal analysis encoding parameters from the short-term prediction residuals. The speech signal encoder also includes a vector quantization unit 116 as means for performing perceptually weighted vector quantization of the sinusoidal analytic encoding parameters, and a second encoding unit 120 as means for encoding the input speech signal by phase transmission waveform encoding.

Figure 2:
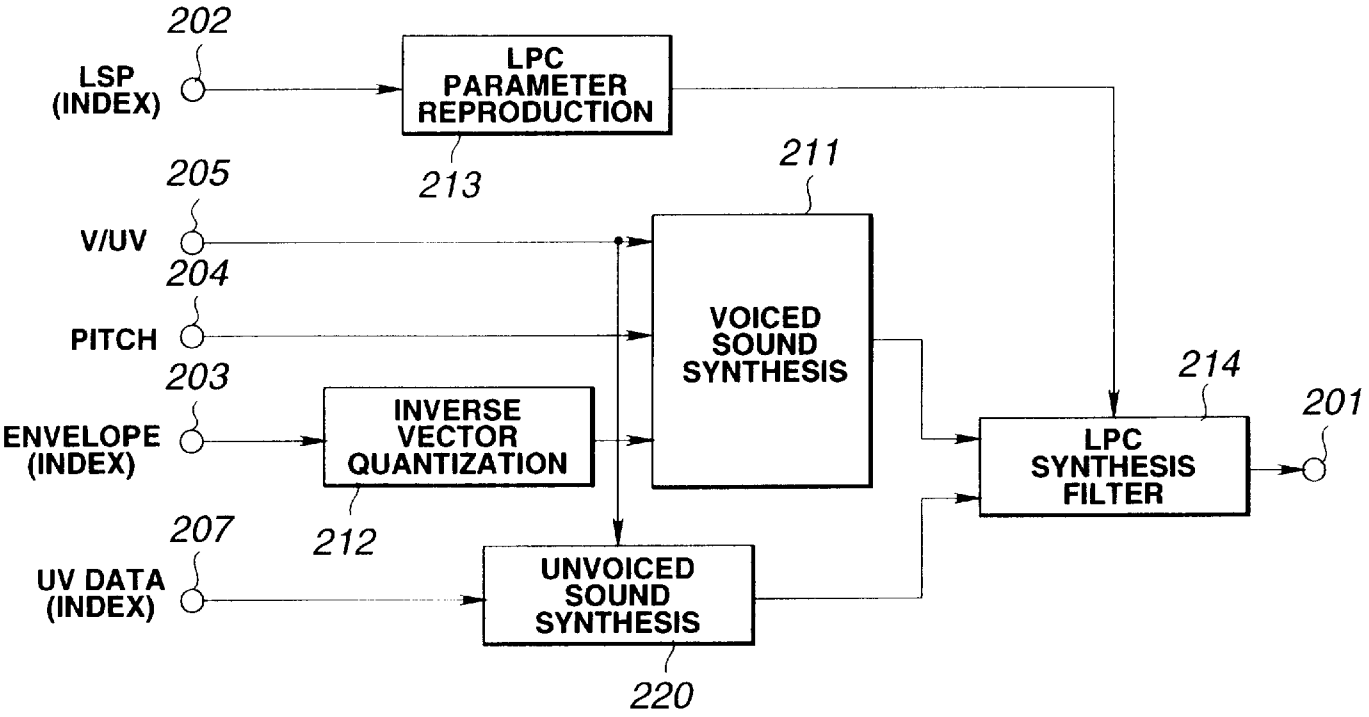
FIG. 2 is a block diagram showing a basic structure of a speech signal decoding apparatus (decoder) which is a counterpart decoder to the encoder shown in FIG. 1.
Figure 3:
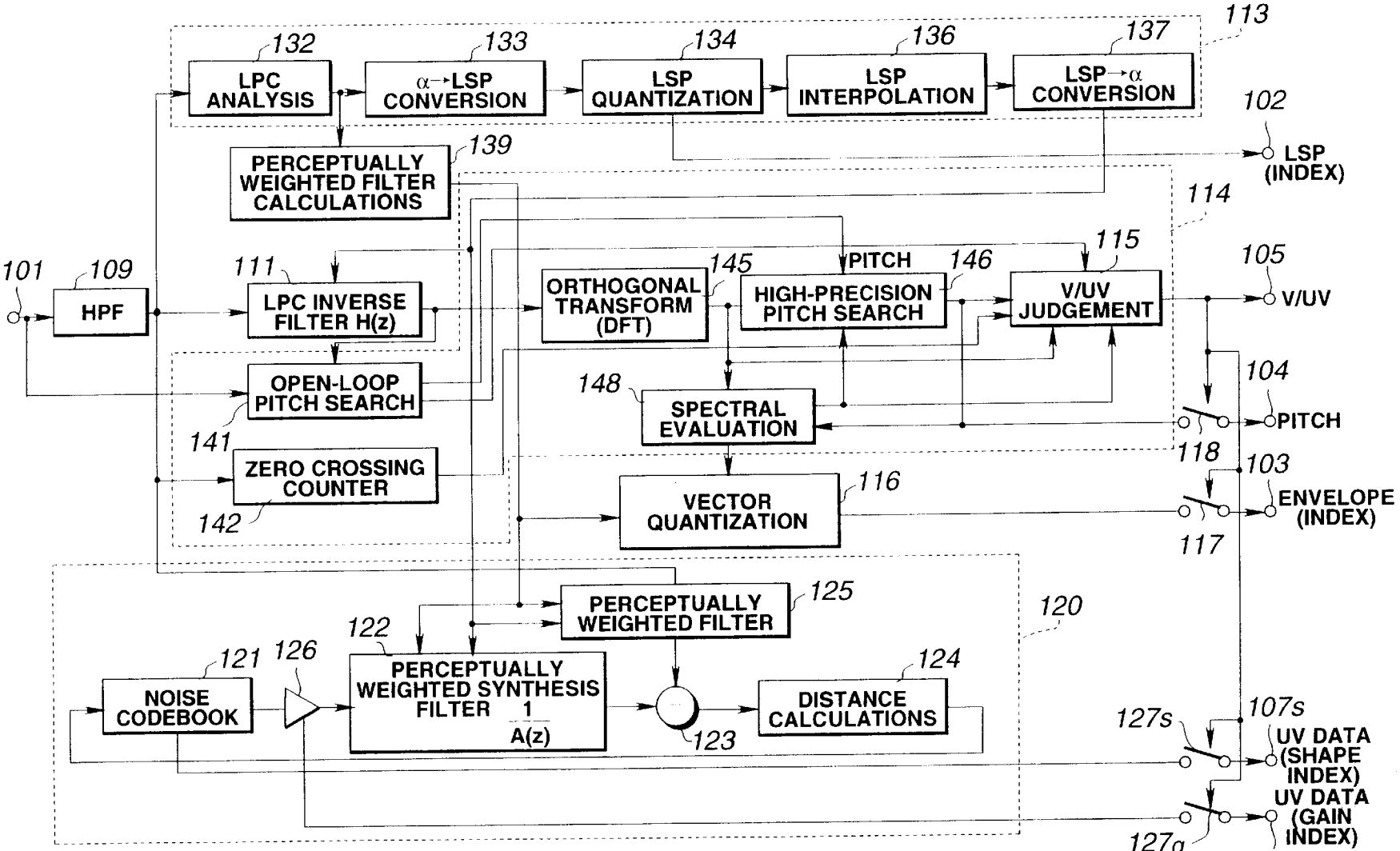
FIG. 3 is a block diagram showing a more detailed structure of the speech signal encoder shown in FIG. 1.
Figure 4:
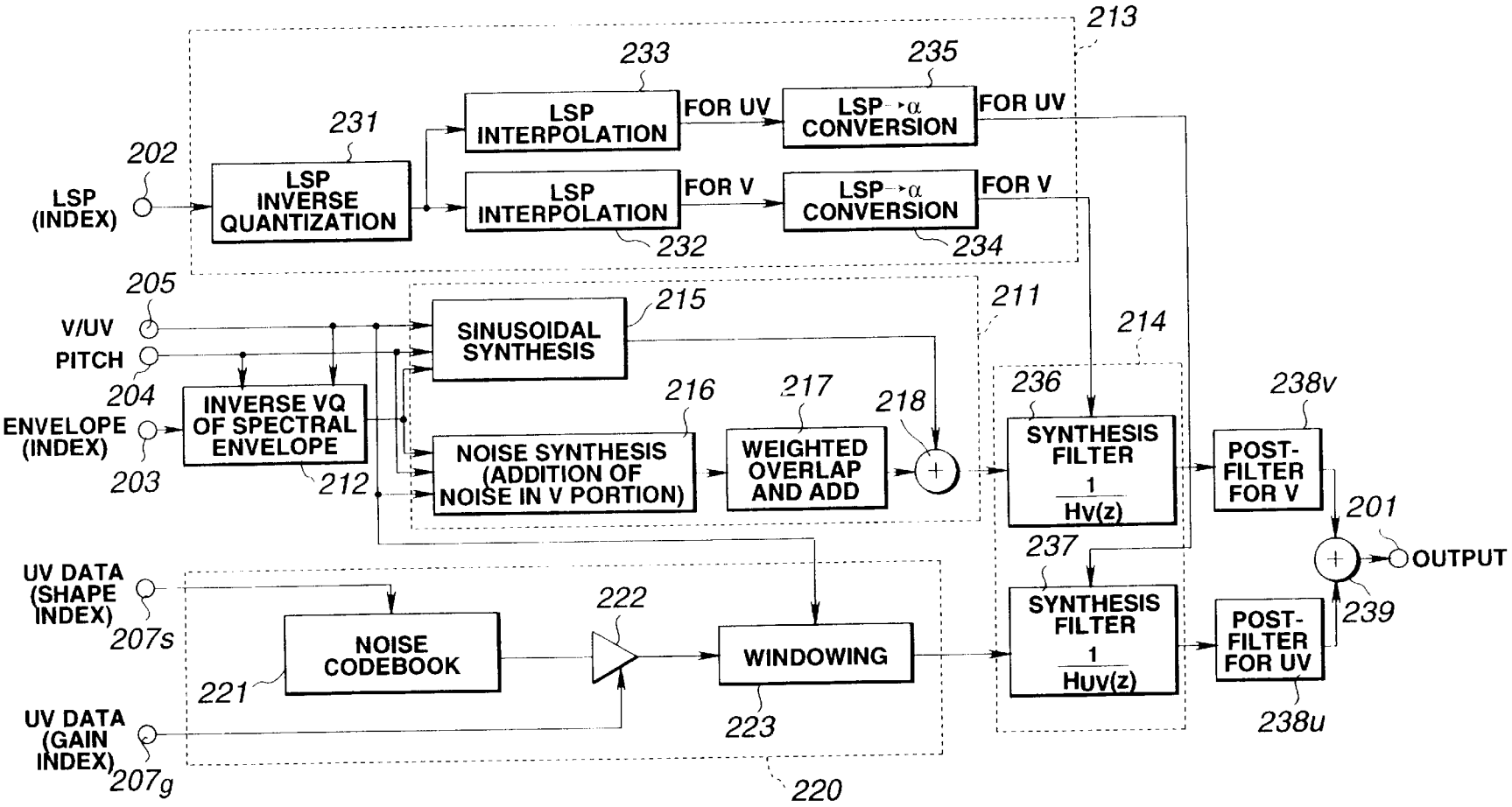
FIG. 4 is a block diagram showing a more detailed structure of the speech decoder shown in FIG. 2.

FIG. 2 is a block diagram showing a basic structure of a speech signal decoding apparatus (decoder) which is a counterpart device of the encoding apparatus (encoder) shown in FIG. 1. FIG. 3 is a block diagram showing a more specified structure of the speech signal encoder shown in FIG. 1. FIG. 4 is a block diagram showing a more detailed structure of the speech decoder shown in FIG. 2. The structures of the block diagrams of FIGS. 1 to 4 are explained below.

The basic concept of the speech signal encoder of FIG. 1 is that the encoder has a first encoding unit 110 for finding short-term prediction residuals, such as linear prediction encoding (LPC) residuals, of the input speech signal for performing sinusoidal analysis encoding, such as harmonic coding, and a second encoding unit 120 for encoding the input speech signal by waveform coding with phase reproducibility, and that the first and second encoding units 110, 120 are used for encoding the voiced portion and unvoiced portion of the input signal, respectively.

The first encoding unit 110 performs encoding of the LPC residuals by sinusoidal analytic encoding such as harmonics encoding or multi-band encoding (MBE). The second encoding unit 120 performs code excitation linear prediction (CELP) employing vector quantization by a closed-loop search for an optimum vector employing an analysis-by-synthesis method.

In this embodiment of the present invention, the speech signal supplied to the input terminal 101 is sent to the inverse LPC filter 111 and an LPC analysis/quantization unit 113 of the first encoding unit 110. The LPC coefficient obtained from the LPC analysis/quantization unit 113, or the so-called α-parameter, is sent to the inverse LPC filter 111 for extracting the linear prediction residuals (LPC residuals) of the input speech signal by the inverse LPC filter 111. From the LPC analysis/quantization unit 113, a quantization output of the linear spectral pairs (LSP) is extracted, as later explained, and sent to an output terminal 102. The LPC residuals from the inverse LPC filter 111 are sent to a sinusoidal analysis encoding unit 114. The sinusoidal analysis encoding unit 114 performs pitch detection, spectral envelope amplitude calculations, and V/UV discrimination by a voiced (V)/ unvoiced (UV) discrimination unit 115. The spectral envelope amplitude data from the sinusoidal analysis encoding unit 114 are sent to the vector quantization unit 116. The codebook index output from the vector quantization unit 116 is a vector quantization output of the spectral envelope data and is sent via a switch 117 to an output terminal 103, while an output of the sinusoidal analysis encoding unit 114 is sent via a switch 118 to an output terminal 104. The V/UV discrimination output from the V/UV discrimination unit 115 is sent to an output terminal 105 and to the switches 117, 118 as switching control signals. For the voiced (V) signal, the index and pitch are selected so as to be extracted at output terminals 103, 104.

In the present embodiment, the second encoding unit 120 of FIG. 1 has a code excitation linear prediction (CELP) encoding configuration, and performs vector quantization of the time-domain waveform employing closed-loop search by the analysis-by-synthesis method in which an output of a noise codebook 121 is synthesized by a weighted synthesis filter 122, the resulting weighted speech is sent to a subtractor 123 where an error between the weighted speech and the speech signal supplied to the input terminal 101 and thence passed through a perceptually weighted filter 125 is extracted and sent to a distance calculation circuit 124 in order to perform distance calculations and a vector which minimizes the error is searched for by the noise codebook 121. This CELP encoding is used for encoding the unvoiced portion as described above. The codebook index is the UV data from the noise codebook 121 and is extracted at an output terminal 107 via a switch 127 which is turned on when the results of V/UV discrimination from the V/UV discrimination unit 115 indicates an unvoiced (UV) sound.

FIG. 2 is a block diagram showing the basic structure of a speech signal decoder, as a counterpart device of the speech signal encoder of FIG. 1, for carrying out the speech decoding method according to the present invention.

Referring to FIG. 2, a codebook index is a quantization output of the linear spectral pairs (LSPs) from the output terminal 102 of FIG. 1 supplied to an input terminal 202. Outputs from the output terminals 103, 104 and 105 of FIG. 1, that is, the index data, pitch and the V/UV discrimination output are the envelope quantization outputs supplied to input terminals 203 to 205, respectively. The index data is the unvoiced data supplied from the output terminal 107 of FIG. 1 to an input terminal 207.

The index is the quantization output of the input terminal 203 and is sent to an inverse vector quantization unit 212 for inverse vector quantization to find a spectral envelope of the LPC residues, which is then sent to a voiced speech synthesizer 211. The voiced speech synthesizer 211 synthesizes the linear prediction encoding (LPC) residuals of the voiced speech portion by sinusoidal synthesis. The voiced speech synthesizer 211 is also fed with the pitch and the V/UV discrimination output from the input terminals 204, 205. The LPC residuals of the voiced speech from the voiced speech synthesis unit 211 are sent to an LPC synthesis filter 214.

The index data of the UV data from the input terminal 207 is sent to an unvoiced sound synthesis unit 220 where reference is made to a noise codebook for taking out the LPC residuals of the unvoiced portion. These LPC residuals are also sent to the LPC synthesis filter 214.

In the LPC synthesis filter 214, the LPC residuals of the voiced portion and the LPC residuals of the unvoiced portion are processed by LPC synthesis. Alternatively, the LPC residuals of the voiced portion and the LPC residuals of the unvoiced portion summed together may be processed by LPC synthesis.

The LSP index data from the input terminal 202 is sent to the LPC parameter reproducing unit 213 where α-parameters of the LPC are extracted and sent to the LPC synthesis filter 214. The speech signals synthesized by the LPC synthesis filter 214 are extracted at an output terminal 201.

Referring to FIG. 3, a more detailed structure of a speech signal encoder shown in FIG. 1 is now explained. In FIG. 3, the parts or components similar to those shown in FIG. 1 are denoted by the same reference numerals.

In the speech signal encoder shown in FIG. 3, the speech signals supplied to the input terminal 101 are filtered by a high-pass filter 109 for removing signals of an unused range and thence supplied to an LPC analysis circuit 132 of the LPC analysis/quantization unit 113 and to the inverse LPC filter 111. The LPC analysis circuit 132 of the LPC analysis/quantization unit 113 applies a Hamming window, with a block or a length of the input signal waveform on the order of 256 samples, and finds a linear prediction coefficient, that is, a so-called α-parameter, by a self-correlation method. The frame interval is a data outputting unit and is set to approximately 160 samples. If the sampling frequency fs is 8 kHz, for example, one frame interval is 20 msec for 160 samples.

The α-parameter from the LPC analysis circuit 132 is sent to an α-LSP conversion circuit 133 for conversion into line spectra pair (LSP) parameters. This converts the α-parameter, as found by a direct type filter coefficient, into ten, that is, five pairs of LSP parameters, for example. This conversion is carried out by, for example, the Newton-Rhapson method. The reason the α-parameters are converted into the LSP parameters is that the LSP parameters are superior in interpolation characteristics to the α-parameters.

The LSP parameters from the α-LSP conversion circuit 133 are matrix- or vector-quantized by the LSP quantizer 134. It is possible to take a frame-to-frame difference prior to vector quantization, or to collect plural frames in order to perform matrix quantization. In the present case, two frames (20 msec) of the LSP parameters, calculated every 20 msec, are collected and processed with matrix quantization and vector quantization.

The quantized output of the quantizer 134, that is the index data of the LSP quantization, are extracted at a terminal 102, while the quantized LSP vector is sent to an LSP interpolation circuit 136.

The LSP interpolation circuit 136 interpolates the LSP vectors, quantized every 20 msec or 40 msec, at an eight-fold rate. That is, the LSP vector is updated every 2.5 msec. The reason is that, if the residual waveform is processed by analysis/synthesis using the harmonic encoding/decoding method, the envelope of the synthetic waveform presents an extremely smooth waveform so that, if the LPC coefficients are changed abruptly every 20 msec, a foreign noise is likely to be produced. If the LPC coefficient is changed gradually every 2.5 msec, however, such a foreign noise may be prevented from occurring.

For inverse filtering of the input speech using the interpolated LSP vectors produced every 2.5 msec, the LSP parameters are converted by an LSP-to-α conversion circuit 137 into α-parameters as coefficients of, for example, ten-order direct type filter. An output of the LSP-to-α conversion circuit 137 is sent to the LPC inverse filter circuit 111 which then performs inverse filtering for producing a smooth output using an α-parameter updated every 2.5 msec. An output of the inverse LPC filter 111 is sent to an orthogonal transform circuit 145, such as a DFT circuit, of the sinusoidal analysis encoding unit 114, such as a harmonic encoding circuit.

The α-parameter from the LPC analysis circuit 132 of the LPC analysis/quantization unit 113 is sent to a perceptually weighted filter calculating circuit 139 where data for perceptual weighting is found. These weighting data are sent to the vector quantizer 116, the perceptually weighted filter 125 of the second encoding unit 120, and the perceptually weighted synthesis filter 122.

The sinusoidal analysis encoding unit 114 of the harmonic encoding circuit analyzes the output of the inverse LPC filter 111 by a method of harmonic encoding. That is, pitch detection, calculation of the amplitudes Am of the respective harmonics, and voiced (V)/unvoiced (UV) discrimination are carried out and the values of the amplitudes Am or the envelopes of the respective harmonics, varied with the pitch, are made constant by dimensional conversion.

In an illustrative example of the sinusoidal analysis encoding unit 114 shown in FIG. 3, commonplace harmonic encoding is used. In particular, in multi-band excitation (MBE) encoding, it is assumed in modeling that voiced portions and unvoiced portions are present in the frequency area or band at the same time point (in the same block or frame). In other harmonic encoding techniques, it is uniquely judged whether the speech in one block or in one frame is voiced or unvoiced. In the following description, a given frame is judged to be UV if the totality of the band is UV, insofar as MBE encoding is concerned.

The open-loop pitch search unit 141 and the zero-crossing counter 142 of the sinusoidal analysis encoding unit 114 of FIG. 3 is fed with the input speech signal from the input terminal 101 and with the signal from the high-pass filter (HPF) 109, respectively. The orthogonal transform circuit 145 of the sinusoidal analysis encoding unit 114 is supplied with LPC residuals or linear prediction residuals from the inverse LPC filter 111. The open loop pitch search unit 141 takes the LPC residuals of the input signals to perform a relatively rough pitch search by an open loop process. The extracted rough pitch data is sent to a fine pitch search unit 146 that operates with a closed loop, as later explained. From the open loop pitch search unit 141, the maximum value of the normalized self correlation r(p), obtained by normalizing the maximum value of the self-correlation of the LPC residuals along with the rough pitch data, are extracted along with the rough pitch data so as to be sent to the V/UV discrimination unit 115.

The orthogonal transform circuit 145 performs orthogonal transformation, such as discrete Fourier transformation (DFT), for converting the LPC residuals on the time axis into spectral amplitude data on the frequency axis. An output of the orthogonal transform circuit 145 is sent to the fine pitch search unit 146 and a spectral evaluation unit 148 for evaluating the spectral amplitude or envelope.

The fine pitch search unit 146 is fed with relatively rough pitch data extracted by the open loop pitch search unit 141 and with frequency-domain data obtained by DFT from the orthogonal transform unit 145. The fine pitch search unit 146 swings the pitch data by plus-or-minus several samples, at a rate of 0.2 to 0.5 and centered about the rough pitch value data, in order to arrive ultimately at the value of the fine pitch data having an optimum decimal point (floating point). The analysis by synthesis method is used as the fine search technique for selecting a pitch so that the power spectrum will be closest to the power spectrum of the original sound. Pitch data from the closed-loop fine pitch search unit 146 is sent to an output terminal 104 via a switch 118.

In the spectral evaluation unit 148, the amplitude of each of the harmonics and the spectral envelope as the sum of the harmonics are evaluated based on the spectral amplitude and the pitch as the orthogonal transform output of the LPC residuals and sent to the fine pitch search unit 146, V/UV discrimination unit 115, and the perceptually weighted vector quantization unit 116.

The V/UV discrimination unit 115 performs V/UV discrimination of a frame based on an output of the orthogonal transform circuit 145, an optimum pitch from the fine pitch search unit 146, spectral amplitude data from the spectral evaluation unit 148, maximum value of the normalized self-correlation r(p) from the open loop pitch search unit 141 and the zero-crossing count value from the zero-crossing counter 142. In addition, the boundary position of the band-based V/UV discrimination for MBE may also be used as a condition for V/UV discrimination. A discrimination output of the V/UV discrimination unit 115 is extracted at an output terminal 105.

An output unit of the spectrum evaluation unit 148 or an input unit of the vector quantization unit 116 is provided with a data number conversion unit (a unit for performing a sort of sampling rate conversion). The data number conversion unit is used for setting the amplitude data|Am| of an envelope taking into account the fact that the number of bands split on the frequency axis and the number of data differ with the pitch. That is, if the effective band is up to 3400 kHz, the effective band can be split into 8 to 63 bands depending on the pitch. The number of mMX+1 of the amplitude data |Am|, obtained from band to band, is changed in a range from 8 to 63. Thus the data number conversion unit converts the amplitude data of the variable number mMx+1 to a pre-set number M of data, such as 44 data.

The amplitude data or envelope data of the pre-set number M, such as 44, from the data number conversion unit, provided at an output unit of the spectral evaluation unit 148 or at an input unit of the vector quantization unit 116, are collected in terms of a pre-set number of data, such as 44 data, as units, by the vector quantization unit 116, by way of performing weighted vector quantization. This weight is supplied by an output of the perceptually weighted filter calculation circuit 139. The index of the envelope from the vector quantizer 116 is extracted by a switch 117 at an output terminal 103. Prior to weighted vector quantization, it is advisable to take an inter-frame difference using a suitable leakage coefficient for a vector made up of a pre-set number of data.

The second encoding unit 120 will now be explained. The second encoding unit 120 has a so-called CELP encoding structure and is used in particular for encoding the unvoiced portion of the input speech signal. In the CELP encoding structure for the unvoiced portion of the input speech signal, a noise output, corresponding to the LPC residuals of the unvoiced sound, is a representative value output of the noise codebook, or a so-called stochastic codebook 121, and is sent via a gain control circuit 126 to a perceptually weighted synthesis filter 122. The weighted synthesis filter 122 LPC synthesizes the input noise and sends the resulting weighted unvoiced signal to the subtractor 123. The subtractor 123 is fed with a signal supplied from the input terminal 101 via an high-pass filter (HPF) 109 and perceptually weighted by a perceptual weighting filter 125. The difference or error between the signal and the signal from the synthesis filter 122 is extracted. Meanwhile, a zero input response of the perceptually weighted synthesis filter 122 is previously subtracted from an output of the perceptual weighting filter output 125. This error is fed to a distance calculation circuit 124 for calculating the distance. A representative vector value which will minimize the error is searched in the noise codebook 121. The above is the summary of the vector quantization of the time-domain waveform employing the closed-loop search in turn employing the analysis by synthesis method.

As data for the unvoiced (UV) portion from the second encoder 120 employing the CELP coding structure, the shape index of the codebook from the noise codebook 121 and the gain index of the codebook from the gain circuit 126 are extracted. The shape index, which is the UV data from the noise codebook 121, and the gain index, which is the UW data of the gain circuit 126, are sent via a switch 127*g* to an output terminal 107*g*.

These switches 127*s*, 127*g* and the switches 117, 118 are turned on and off depending on the results of a V/UV decision from the V/UV discrimination unit 115. Specifically, the switches 117, 118 are turned on, if the results of V/UV discrimination of the speech signal of the frame currently transmitted indicates voiced (V), while the switches 127*s*, 127*g* are turned on if the speech signal of the frame currently transmitted is unvoiced (UV).

FIG. 4 shows a more detailed structure of the speech signal decoder shown in FIG. 2. In FIG. 4, the same numerals are used to denote the components shown in FIG. 2.

In FIG. 4, a vector quantization output of the LSP quantizer corresponding to the output at terminal 102 of FIGS. 1 and 3, that is, the codebook index, is supplied to an input terminal 202.

The LSP index is sent to the LSP inverse vector quantizer 231 of the LPC parameter reproducing unit 213 so as to be inverse vector quantized to line spectral pair (LSP) data which are then supplied to LSP interpolation circuits 232, 233 for interpolation. The resulting interpolated data is converted by the LSP-to-α conversion circuits 234, 235 to α parameters which are sent to the LPC synthesis filter 214. The LSP interpolation circuit 232 and the LSP-to-α conversion circuit 234 are designed for voiced (V) sound, while the LSP interpolation circuit 233 and the LSP-to-α conversion circuit 235 are designed for unvoiced (UV) sound. The LPC synthesis filter 214 uses an LPC synthesis filter 236 for the voiced speech portion and a separate LPC synthesis filter 237 for the unvoiced speech portion. That is, LPC coefficient interpolation is carried out independently for the voiced speech portion and the unvoiced speech portion for preventing unwanted effects from being produced in the transition portion from the voiced speech portion to the unvoiced speech portion or vice versa by interpolation of the LSPs of totally different properties.

To an input terminal 203 of FIG. 4 is supplied code index data corresponding to the weighted vector quantized spectral envelope Am available at the output terminal 103 of the encoder of FIGS. 1 and 3. To an input terminal 204 is supplied pitch data from the terminal output 104 of FIGS. 1 and 3. To an input terminal 205 is supplied V/UV discrimination data from the output terminal 105 of FIGS. 1 and 3.

The vector-quantized index data of the spectral envelope Am from the input terminal 203 is sent to an inverse vector quantizer 212 for inverse vector quantization where an inverse conversion with respect to the data number conversion is carried out. The resulting spectral envelope data is sent to a sinusoidal synthesis circuit 215.

If the inter-frame difference is found prior to vector quantization of the spectrum during encoding, the inter-frame difference is decoded after inverse vector quantization to produce the spectral envelope data.

The sinusoidal synthesis circuit 215 is fed with the pitch from the input terminal 204 and the V/UV discrimination data from the input terminal 205. From the sinusoidal synthesis circuit 215, LPC residual data corresponding to the output of the LPC inverse filter 111 shown in FIGS. 1 and 3 are extracted and sent to an adder 218.

The envelope data of the inverse vector quantizer 212 and the pitch and the V/UV discrimination data from the input terminals 204, 205 are sent to a noise synthesis circuit 216 for noise addition for the voiced portion (V). An output of the noise synthesis circuit 216 is sent to an adder 218 via a weighted overlap-add circuit 217. Specifically, the noise takes into account the fact that, if the excitation is an input to the LPC synthesis filter of the voiced sound and is produced by sine wave synthesis, a stuffed feeling is produced in the low-pitch sound such as in male speech, and the sound quality is abruptly changed between the voiced sound and the unvoiced sound thus producing an unnatural hearing feeling is added to the voiced portion of the LPC residual signals. Such noise takes into account the parameters concerned with speech encoding data, such as pitch, amplitudes of the spectral envelope, maximum amplitude in a frame, and the residual signal level, in connection with the LPC synthesis filter input of the voiced speech portion, that is, excitation.

An output of the adder 218 is sent to a synthesis filter 236 for the voiced sound of the LPC synthesis filter 214 where LPC synthesis is carried out to form time waveform data which then is filtered by a post-filter 238*v* for the voiced speech and sent to the adder 239.

The shape index and the gain index, as UV data from the output terminals 107*s* and 107*g* of FIG. 3, are supplied to the input terminals 207*s* and 207*g* of FIG. 4, and thence supplied to the unvoiced speech synthesis unit 220. The shape index from the terminal 207*s* is sent to the noise codebook 221 of the unvoiced speech synthesis unit 220, while the gain index from the terminal 207*g* is sent to the gain circuit 222. The representative value output read out from the noise codebook 221 is a noise signal component corresponding to the LPC residuals of the unvoiced speech. This becomes a pre-set gain amplitude in the gain circuit 222 and is sent to a windowing circuit 223 so as to be windowed for smoothing the junction between the unvoiced speech portion and the voiced speech portion.

An output of the windowing circuit 223 is sent to a synthesis filter 237 for the unvoiced (UV) speech of the LPC synthesis filter 214. The data sent to the synthesis filter 237 is processed by LPC synthesis to become time waveform data for the unvoiced portion. The time waveform data of the unvoiced portion is filtered by a post-filter for the unvoiced portion before being sent to an adder 239.

In the adder 239, the time waveform signal from the post-filter for the voiced speech 238*v* and the time waveform data for the unvoiced speech portion from the post-filter 238*u* for the unvoiced speech are added to each other and the resulting sum data is taken out at the output terminal 201.

The above-described speech signal encoder can output data of different bit rates depending on the required sound quality. That is, the output data can be output with variable bit rates. For example, if the low bit rate is 2 kbps and the high bit rate is 6 kbps, the output data has the bit rates shown in FIG. 15.

The pitch data from the output terminal 104 is output at all times at a bit rate of 8 bits/20 msec for the voiced speech, with the V/UV discrimination output from the output terminal 105 being at all times 1 bit/20 msec. The index for LSP quantization, output from the output terminal 102, is switched between 32 bits/40 msec and 48 bits/40 msec. On the other hand, the index during the voiced speech (V) output by the output terminal 103 is switched between 15 bits/20 msec and 87 bits/20 msec. The index for the unvoiced (UV) portion output from the output terminals 107*s* and 107*g* is switched between 11 bits/10 msec and 23 bits/5 msec. The output data for the voiced sound (UV) is 40 bits/20 msec for 2 kbps and 120 kbps/20 msec for 6 kbps. On the other hand, the output data for the voiced sound (UV) is 39 bits/20 msec for 2 kbps and 117 kbps/20 msec for 6 kbps.

The index for LSP quantization, the index for voiced speech (V), and the index for the unvoiced speech (UV) are explained later on in connection with the arrangement of pertinent portions.

Figure 5:
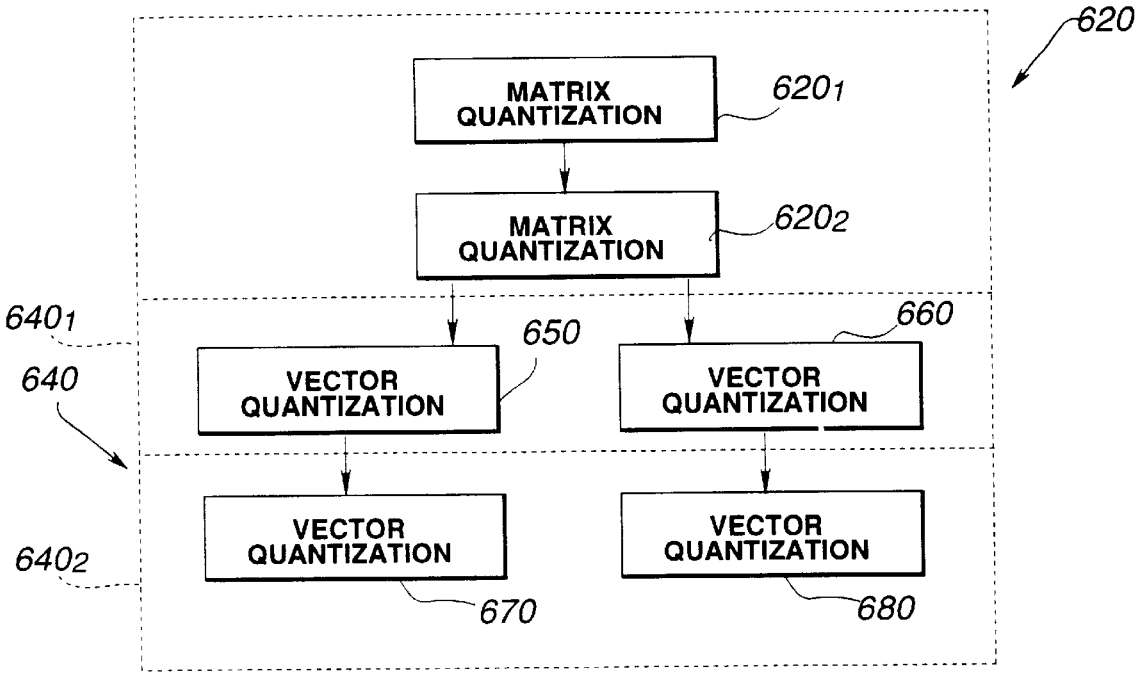
FIG.5 (PRIOR ART)
FIG. 5 is a block diagram showing a basic structure of an LPC quantizer.
Figure 6:
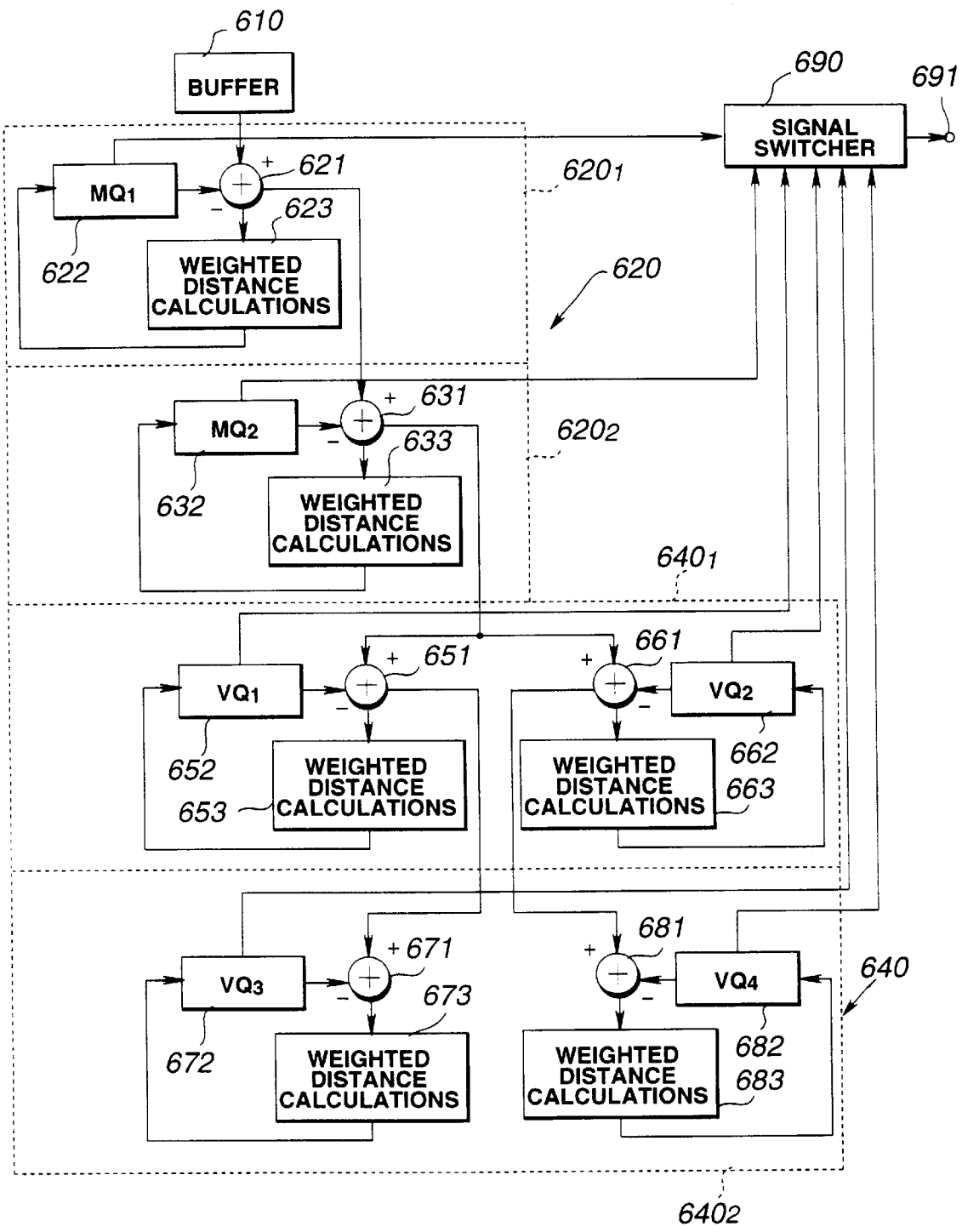
FIG.6 (PRIOR ART)
FIG. 6 is a block diagram showing a more detailed structure of the LPC quantizer.

Referring to FIGS. 5 and 6, matrix quantization and vector quantization in the LSP quantizer 134 are explained in detail.

The α-parameter from the LPC analysis circuit 132 is sent to an α-LSP circuit 133 for conversion to LSP parameters. If the P-order LPC analysis is performed in a LPC analysis circuit 132, P α-parameters are calculated. These P α-parameters are converted into LSP parameters which are held in a buffer 610 of FIG. 6.

The buffer 610 outputs two frames of LSP parameters. The two frames of LSP parameters are matrix-quantized by a matrix quantizer 620 made up of a first matrix quantizer $\mathbf{620}_1$ and a second matrix quantizer $\mathbf{620}_2$. The two frames of LSP parameters are matrix-quantized in the first matrix quantizer $\mathbf{620}_1$ and the resulting quantization error is further matrix-quantized in the second matrix quantizer $\mathbf{620}_2$. The matrix quantization exploits correlation both in the time domain and in the frequency domain.

The quantization error for the two frames from the matrix quantizer $\mathbf{620}_2$ enters a vector quantization unit 640 made up of a first vector quantizer $\mathbf{640}_1$ and a second vector quantizer $\mathbf{640}_2$. The first vector quantizer $\mathbf{640}_1$ is made up of two vector quantization portions 650, 660, while the second vector quantizer $\mathbf{640}_2$ is made up of two vector quantization portions 670, 680. The quantization error from the matrix quantization unit 620 is quantized on the frame basis by the vector quantization portions 650, 660 of the first vector quantizer $\mathbf{640}_1$. The resulting quantization error vector is further vector-quantized by the vector quantization portions 670, 680 of the second vector quantizer $\mathbf{640}_2$. The above described vector quantization exploits correlation in the frequency domain.

The matrix quantization unit 620, executing the matrix quantization as described above, includes at least a first matrix quantizer $\mathbf{620}_1$ for performing a first matrix quantization step and a second matrix quantizer $\mathbf{620}_2$ for performing a second matrix quantization step for matrix quantizing the quantization error produced by the first matrix quantization. The vector quantization unit 640, executing the vector quantization as described above, includes at least a first vector quantizer $\mathbf{640}_1$ for performing a first vector quantization step and a second vector quantizer $\mathbf{640}_2$ for performing a second vector quantization step for vector quantizing the quantization error produced by the first vector quantization.

The matrix quantization and the vector quantization will now be explained in detail.

The LSP parameters for two frames, stored in the buffer 610, that is, a 10×2 matrix, is sent to the first matrix quantizer $\mathbf{620}_1$. The first matrix quantizer $\mathbf{620}_1$ sends LSP parameters for two frames via LSP parameter adder 621 to a weighted distance calculating unit 623 for finding the weighted distance of the minimum value.

The distortion measure $d_{MQ1}$ during the codebook search by the first matrix quantizer $\mathbf{620}_1$ is given by equation (1):

$$d_{MQ1}(X_1, X_1') = \sum_{t=0}^{1} \sum_{i=1}^{P} w(t, i)(x_1(t, i) - x_1'(t, i))^2 \tag{1}$$

where $X_1$ is the LSP parameter and $X_1'$ is the quantization value, and t and i are the numbers of the P-dimension.

The weight w(t, i), in which weight limitation in the frequency domain and in the time domain is not taken into account, is given by equation (2):

$$w(t, i) = \frac{1}{x(t, i+1) - x(t, i)} + \frac{1}{x(t, i) - x(t, i-1)} \tag{2}$$

where x(t, 0)=0, and x(t, p+1)=π regardless of t.

The weight given by equation (2) is also used for downstream-side matrix quantization and vector quantization.

The calculated weighted distance is sent to a matrix quantizer $MQ_1$ 622 for matrix quantization. An 8-bit index outputted by this matrix quantization is sent to a signal switcher 690. The quantization value by matrix quantization is subtracted from LSP parameters for the two frames by an adder 621. A weighted distance calculating unit 623 sequentially calculates the weighted distance for every two frames so that matrix quantization is carried out in the matrix quantization unit 622. Also, a quantization value minimizing the weighted distance is selected. An output of the adder 621 is sent to an adder 631 of the second matrix quantizer $\mathbf{620}_2$.

The second matrix quantizer $\mathbf{620}_2$ performs matrix quantization similar to the first matrix quantizer $\mathbf{620}_1$. An output of the adder 621 is sent via adder 631 to a weighted distance calculation unit 633 where the minimum weighted distance is calculated.

The distortion measure $d_{MQ2}$ during the codebook search by the second matrix quantizer $\mathbf{620}_2$ is given by equation (3):

$$d_{MQ2}(X_2, X_2') = \sum_{t=0}^{1} \sum_{i=1}^{P} w(t, i)(x_2(t, i) - x_2'(t, i))^2 \tag{3}$$

where $X_2$ and $X_2'$ are the quantization error and the quantization value from the first matrix quantizer $\mathbf{620}_1$, respectively.

The weighted distance is sent to a matrix quantization unit $MQ_2$ 632 for matrix quantization. An 8-bit index output by this matrix quantization is subtracted from the two-frame quantization error by the adder 631. The weighted distance calculation unit 633 sequentially calculates the weighted distance using the output of the adder 631. The quantization value minimizing the weighted distance is selected. An output of the adder 631 is sent to the adders 651, 661 of the first vector quantizer $\mathbf{640}_1$ frame by frame.

The first vector quantizer $\mathbf{640}_1$ performs vector quantization frame by frame. An output of the adder 631 is sent frame by frame to each of weighted distance calculating units 653, 663 via adders 651, 661 for calculating the minimum weighted distance.

The difference between the quantization error $X_2$ and the quantization error $X_2'$ is a matrix of (10×2). If the difference is represented as $X_2-X_2'=[\underline{x}_{3-1}, \underline{x}_{3-2}]$, the distortion measures $d_{vQ1}$, $d_{vQ2}$ during codebook search by the vector quantization units 652, 662 of the first vector quantizer $\mathbf{640}_1$ are given by equations (4) and (5):

$$d_{VQ1}(\underline{x}_{3-1}, \underline{x}_{3-1}') = \sum_{i=1}^{P} w(0, i)(x_{3-1}(0, i) - x_{3-1}'(0, i))^2 \tag{4}$$

$$d_{VQ2}(\underline{x}_{3-2}, \underline{x}_{3-2}') = \sum_{i=1}^{P} w(1, i)(x_{3-2}(1, i) - x_{3-2}'(1, i))^2 \tag{5}$$

The weighted distance is sent to a vector quantization $VQ_1$ 652 and a vector quantization unit $VQ_2$ 662 for vector quantization. Each 8-bit index outputted by this vector quantization is sent to the signal switcher 690. The quantization value is subtracted by the adders 651, 661 from the input two-frame quantization error vector. The weighted distance calculating units 653, 663 sequentially calculate the weighted distance, using the outputs of the adders 651, 661, for selecting the quantization value minimizing the weighted distance. The outputs of the adders 651, 661 are sent to adders 671, 681 of the second vector quantizer $\mathbf{640}_2$.

The distortion measures $d_{VQ3}$, $d_{VQ4}$ during codebook searching by the vector quantizers 672, 682 of the second vector quantizer $\mathbf{640}_2$, for $$\underline{x}_{4-1}=x_{3-1}-\underline{x}_{3-1}'$$

$$\underline{x}_{4-2}=x_{3-2}-\underline{x}_{3-2}'$$

are given by equations (6) and (7):

$$d_{VQ3}(\underline{x}_{4-1}, \underline{x}_{4-1}') = \sum_{i=1}^{P} w(0, i)(x_{4-1}(0, i) - x_{4-1}'(0, i))^2 \tag{6}$$

$$d_{VQ4}(\underline{x}_{4-2}, \underline{x}_{4-2}') = \sum_{i=1}^{P} w(1, i)(x_{4-2}(1, i) - x_{4-2}'(1, i))^2 \tag{7}$$

These weighted distances are sent to the vector quantizer $VQ_3$ 672 and to the vector quantizer $VQ_4$ 682 for vector quantization. The 8-bit output index data from vector quantization are subtracted by the adders 671, 681 from the input quantization error vector for the two frames. The weighted distance calculating units 673, 683 sequentially calculate the weighted distances using the outputs of the adders 671, 681 for selecting the quantization value minimizing the weighted distances.

Codebook learning is performed by the general Lloyd algorithm based on the respective distortion measures. The distortion measures during codebook searching and during learning may be the same or different values.

The 8-bit index data from the matrix quantization units 622, 632 and the vector quantization units 652, 662, 672 and 682 are switched by the signal switcher 690 and outputted at an output terminal 691.

Specifically, for a low-bit rate, outputs of the first matrix quantizer $\mathbf{620}_1$ carrying out the first matrix quantization step, second matrix quantizer $\mathbf{620}_2$ carrying out the second matrix quantization step and the first vector quantizer $\mathbf{640}_1$ carrying out the first vector quantization step are extracted, whereas, for a high bit rate, the output for the low bit rate is summed to an output of the second vector quantizer $\mathbf{640}_2$ carrying out the second vector quantization step and the resulting sum is extracted. This outputs an index of 32 bits/40 msec and an index of 48 bits/40 msec for 2 kbps and 6 kbps, respectively.

The matrix quantization unit 620 and the vector quantization unit 640 perform weighting limited in the frequency domain and/or the time domain in conformity with characteristics of the parameters representing the LPC coefficients.

The weighting limited in the frequency domain in conformity with characteristics of the LSP parameters will now be explained.

If the number of orders is P=10, the LSP parameters X(i) are grouped into $$L_1=\{X(i)|1 \leqq i \leqq 2\}$$

$$L_2=\{X(i)|3 \leqq i \leqq 6\}$$

$$L_3=\{X(i)|7 \leqq i \leqq 10\}$$

for three ranges: low, mid and high. If the weighting of the groups $L_1$, $L_2$ and $L_3$ is ¼, ½ and ¼, the weighting limited only in the frequency domain is given by equations (8), (9) and (10):

$$w'(i) = \frac{w(i)}{\sum_{j=1}^{2} w(j)} \times \frac{1}{4} \tag{8}$$

$$w'(i) = \frac{w(i)}{\sum_{j=3}^{6} w(j)} \times \frac{1}{2} \tag{9}$$

$$w'(i) = \frac{w(i)}{\sum_{j=7}^{10} w(j)} \times \frac{1}{4}\ . \tag{10}$$

The weighting of the respective LSP parameters is performed in each group only and such weighting is limited by the weighting for each group.

Looking in the time axis direction, the sum total of the respective frames is necessarily 1, so that limitation in the time axis direction is frame-based. The weighting limited only in the time axis direction is given by equation (11):

$$w'(i, t) = \frac{w(i, t)}{\sum_{j=1}^{10} \sum_{s=0}^{1} w(j, s)} \tag{11}$$

where $1 \leqq i \leqq 10$ and $0 \leqq t \leqq 1$.

By equation (11), weighting not limited in the frequency axis direction is carried out between two frames with the frame numbers of t=0 and t=1. This weighting limited only in the time axis direction is carried out between two frames processed with matrix quantization.

During learning, the totality of frames used as learning data, having the total number T, is weighted in accordance with equation (12):

$$w'(i,t)=\frac{w(i,t)}{\sum_{j=1}^{10}\sum_{s=0}^{T}w(j,s)} \tag{12}$$

where $1 \leqq i \leqq 10$ and $0 \leqq t \leqq T$

The weighting limited in the frequency axis direction and in the time axis direction will now be explained.

If the number of orders is P=10, the LSP parameters X(i, t) are grouped into $$L_1=\{X(i,t)|1\leqq i\leqq 2,\ 0\leqq t\leqq 1\}$$

$$L_2=\{X(i,t)|3\leqq i\leqq 6,\ 0\leqq t\leqq 1\}$$

$$L_3=\{X(i,t)|7\leqq i\leqq 10,\ 0\leqq t\leqq 1\}$$

for the three ranges: low, mid and high. If the weighting of the groups $L_1$, $L_2$ and $L_3$ is ¼, ½ and ¼, the weighting limited only in the frequency domain is given by equations (13), (14) and (15):

$$w'(i,t)=\frac{w(i,t)}{\sum_{j=1}^{2}\sum_{s=0}^{1}w(j,s)}\times\frac{1}{4} \tag{13}$$

$$w'(i,t)=\frac{w(i,t)}{\sum_{j=3}^{6}\sum_{s=0}^{1}w(j,s)}\times\frac{1}{2} \tag{14}$$

$$w'(i,t)=\frac{w(i,t)}{\sum_{j=7}^{10}\sum_{s=0}^{1}w(j,s)}\times\frac{1}{4} \tag{15}$$

By these equations (13) to (15), weighting limited every three frames in the frequency axis direction and across two frames processed with matrix quantization is carried out. This is effective during codebook search and during learning.

During learning, weighting is for the totality of frames of the entire data. The LSP parameters X(i, t) are grouped into $$L_1=\{X(i,t)|1\leqq i\leqq 2,\ 0\leqq t\leqq T\}$$

$$L_2=\{X(i,t)|3\leqq i\leqq 6,\ 0\leqq t\leqq T\}$$

$$L_3=\{X(i,t)|7\leqq i\leqq 10,\ 0\leqq t\leqq T\}$$

for low, mid and high ranges. If the weighting of the groups $L_1$, $L_2$ and $L_3$ is ¼, 1/2 and ¼, the weighting for the groups $L_1$, $L_2$ and $L_3$, limited only in the frequency axis, is given by equations (16), (17), and (18):

$$w'(i,t)=\frac{w(i,t)}{\sum_{j=1}^{2}\sum_{s=0}^{T}w(j,s)}\times\frac{1}{4} \tag{16}$$

$$w'(i,t)=\frac{w(i,t)}{\sum_{j=3}^{6}\sum_{s=0}^{T}w(j,s)}\times\frac{1}{2} \tag{17}$$

$$w'(i,t)=\frac{w(i,t)}{\sum_{j=7}^{10}\sum_{s=0}^{T}w(j,s)}\times\frac{1}{4} \tag{18}$$

By these equations (16) to (18), weighting can be performed for three ranges in the frequency axis direction and across the totality of frames in the time axis direction.

In addition, the matrix quantization unit 620 and the vector quantization unit 640 perform weighting depending on the magnitude of changes in the LSP parameters. In V to UV or UV to V transition regions, which represent a minority of frames among the totality of speech frames, the LSP parameters are changed primarily due to the difference in the frequency response between consonants and vowels. Therefore, the weighting shown by equation (19) may be multiplied by the weighting W'(i, t) for weighting placing emphasis on the transition regions.

$$wd(t)=\sum_{i=1}^{10}|x_1(i,t)-x_1(i,t-1)|2 \tag{19}$$

The following equation (20):

$$wd(t)=\sum_{i=1}^{10}\sqrt{|x_1(i,t)-x_1(i,t-1)|} \tag{20}$$

may be used in place of the equation (19).

Thus the LSP quantization unit 134 executes two-stage matrix quantization and two-stage vector quantization to render the number of bits of the output index variable.

Figure 7:
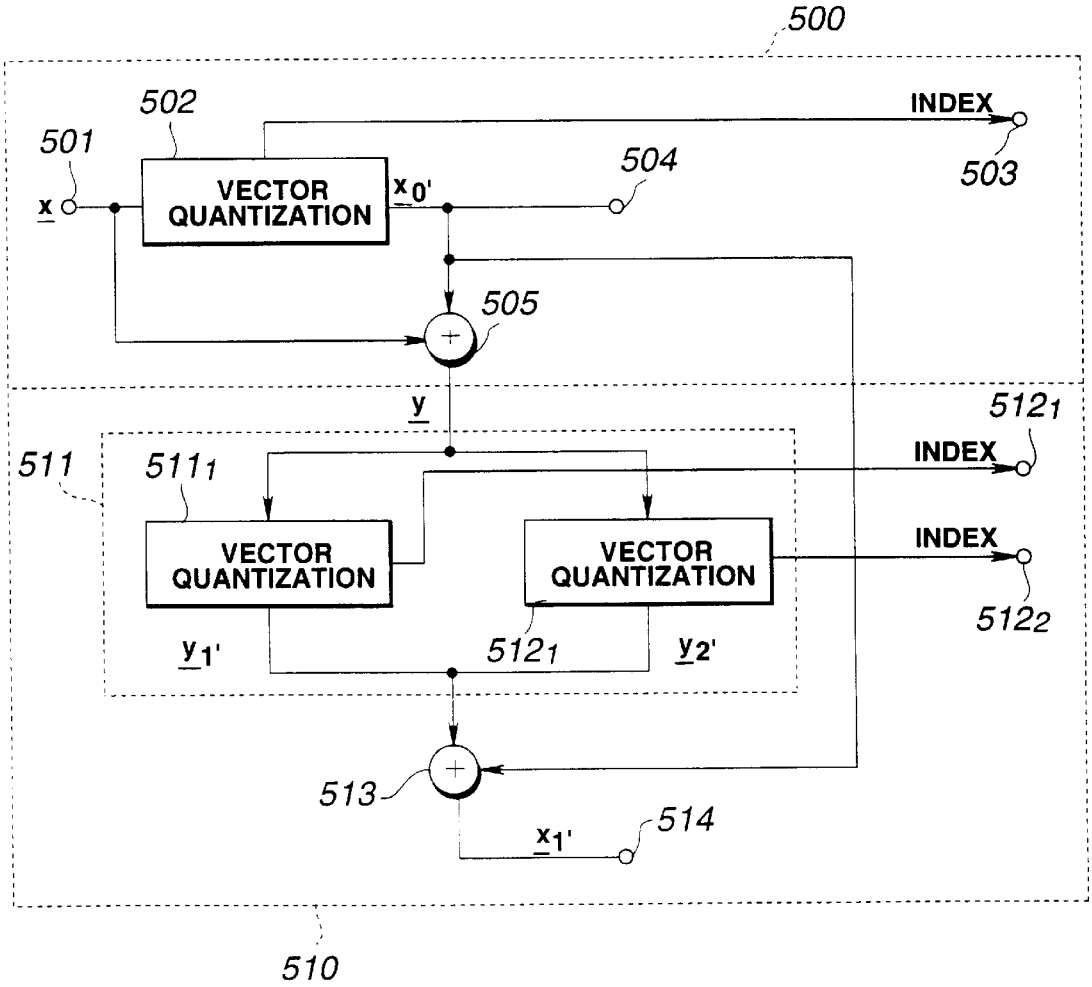
FIG.7 (PRIOR ART)
FIG. 7 is a block diagram showing a basic structure of a vector quantizer.
Figure 8:
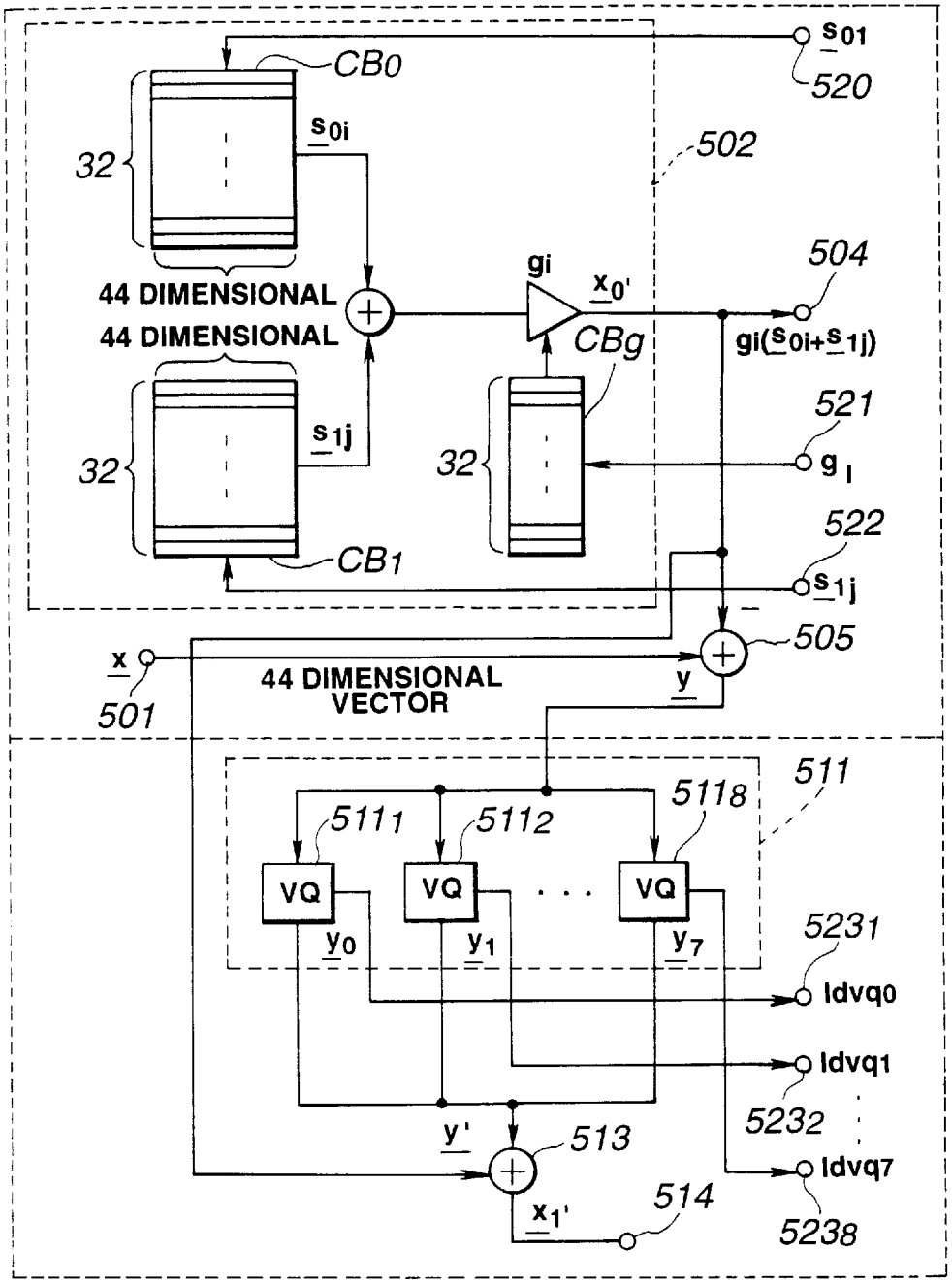
FIG.8 (PRIOR ART)
FIG. 8 is a block diagram showing a more detailed structure of the vector quantizer.

The basic structure of the vector quantization unit 116 is shown in FIG. 7, while a more detailed structure of the vector quantization unit 116 is shown in FIG. 8. An illustrative structure use for weighted vector quantization for the spectral envelope Am in the vector quantization unit 116 will now be explained.

First, in the speech signal encoding device shown in FIG. 3, an illustrative arrangement for data number conversion for providing a constant number of data of the amplitude of the spectral envelope on an output side of the spectral evaluating unit 148 or on an input side of the vector quantization unit 116 is explained.

A variety of methods may be conceived for such data number conversion. In the present embodiment, dummy data interpolating the values from the last data in a block to the first data in the block or other pre-set data such as data repeating the last data or the first data in a block are appended to the amplitude data of one block of an effective band on the frequency axis for enhancing the number of data to $N_F$, amplitude data equal in number to Os times, such as eight times, are found by Os-fold, such as eight-fold oversampling of the limited bandwidth type by, for example, an FIR filter. The ((mM ×+1)×Os) amplitude data are linearly interpolated for expansion to a larger $N_M$ number, such as 2048. This $N_M$ data is sub-sampled for conversion to the above-mentioned pre-set number M of data, such as 44 data.

In effect, only data necessary for formulating M data ultimately required is calculated by oversampling and linear interpolation without finding the above-mentioned $N_M$ data.

The vector quantization unit 116 for carrying out the weighted vector quantization of FIG. 7 includes at least a first vector quantization unit 500 for performing the first vector quantization step and a second vector quantization unit 510 for carrying out the second vector quantization step for quantizing the quantization error vector produced during the first vector quantization by the first vector quantization unit 500. This first vector quantization unit 500 is a so-called first-stage vector quantization unit, while the second vector quantization unit 510 is a so-called second-stage vector quantization unit.

An output vector x of the spectral evaluation unit 148, which is envelope data having a pre-set number M, enters an input terminal 501 of the first vector quantization unit 500. This output vector x is quantized with weighted vector quantization by the vector quantization unit 502. Thus, a shape index outputted by the vector quantization unit 502 is fed out at an output terminal 503, while a quantized value $x_0'$ is output at an output terminal 504 and sent to adders 505, 513. The adder 505 subtracts the quantized value $x_0'$ from the source vector x to give a multi-order quantization error vector y.

The quantization error vector y is sent to a vector quantization unit 511 in the second vector quantization unit 510. This second vector quantization unit 511 is made up of plural vector quantization units, or two vector quantizers $\mathbf{511}_1$, $\mathbf{511}_2$ in FIG. 7. The quantization error vector y is dimensionally split so as to be quantized by weighted vector quantization in the two vector quantizers $\mathbf{511}_1$, $\mathbf{511}_2$. The shape index output by these vector quantizers $\mathbf{511}_1$, $\mathbf{511}_2$ is output at output terminals $\mathbf{512}_1$, $\mathbf{512}_2$, while the quantized values $y_1'$, $y_2'$ are connected in the dimensional direction and sent to an adder 513. The adder 513 adds the quantized values $y_1'$, $y_2'$ to the quantized value $x_0'$ to generate a quantized value $x_1'$ which is output at an output terminal 514.

Thus, for the low bit rate, an output of the first vector quantization step by the first vector quantization unit 500 is taken out, whereas, for the high bit rate, an output of the first vector quantization step and an output of the second quantization step by the second quantization unit 510 are output.

Specifically, the vector quantizer 502 in the first vector quantization unit 500 in the vector quantization section 116 is of an L-order, such as 44-order two-stage structure, as shown in FIG. 8.

That is, the sum of the output vectors of the 44-order vector quantization codebook with the codebook size of 32, multiplied with a gain $g_i$, is used as a quantized value $x_0'$ of the 44-order spectral envelope vector x. Thus, as shown in FIG. 8, the two codebooks are CB0 and CB1, while the output vectors are $s_{0i}$, $s_{1j}$, where $0 \leqq i$ and $j \leqq 31$. On the other hand, an output of the gain codebook $CB_g$ is $g_1$, where $0 \leqq 1 \leqq 31$, and where $g_1$ is a scalar. An ultimate output $x_0'$ is $g_1$ $(s_{0i}+s_{1j})$.

The spectral envelope Am obtained by the above MBE analysis of the LPC residuals and converted into a pre-set order is x. It is crucial how efficiently x is to be quantized.

The quantization error energy E is defined by $$\begin{aligned} E &= \|W\{H\underline{x} - Hg_1((\underline{s}_{0i} + \underline{s}_{1j})\}\|^2 \\ &= \|WH\{\underline{x} - \{\underline{x} - g_1(\underline{s}_{0i} + \underline{s}_{1j})\}\|^2 \end{aligned} \tag{21}$$

where H denotes characteristics on the frequency axis of the LPC synthesis filter and W a matrix for weighting for representing characteristics for perceptual weighting on the frequency axis.

If the $\alpha$-parameter by the results of LPC analysis of the current frame is denoted as $\alpha_i$ $(1 \leqq i \leqq P)$, the values of the L-order, for example, 44-order corresponding points, are sampled from the frequency response of equation (22):

$$H(z) = \frac{1}{1 + \sum_{i=1}^{P} \alpha_i z^{-i}} \tag{22}$$

For calculations, "0"s are placed next to a string of 1, $\alpha_1$, $\alpha_2$, . . . $\alpha_p$ to give a string of 1, $\alpha_1$, $\alpha_2$, . . . $\alpha_p$, 0, 0 , . . . , 0 to give, for example, 256-point data. Then, by 256-point FFT, $(re^2+im^2)^{1/2}$ is calculated for points associated with a range from 0 to $\pi$ and the reciprocals of the results are found. These reciprocals are sub-sampled to L points, such as 44 points, and a matrix is formed having these L points as diagonal elements:

$$H = \begin{bmatrix} h(1) & & & 0 \\ & h(2) & & \\ & & \ddots & \\ 0 & & & h(L) \end{bmatrix}$$

A perceptually weighted matrix W is given by equation (23):

$$W(z) = \frac{1 + \sum_{i=1}^{P} \alpha_i \lambda_b^i z^{-i}}{1 + \sum_{i=1}^{P} \alpha_i \lambda_a^i z^{-i}} \tag{23}$$

where $\alpha_i$ is the result of the LPC analysis, and $\lambda a$, $\lambda b$ are constants, such that $\lambda a=0.4$ and $\lambda b=0.9$.

The matrix W may be calculated from the frequency response of the above equation (23). For example, FFT is done on 256-point data of 1, $\alpha_1\lambda b$, $\alpha_2\lambda b^2$, . . . $\alpha_P\lambda b^P$, 0, 0, . . . , 0 to find $(re^2[i] + im^2[i])^{1/2}$ for a domain from 0 to $\pi$, where $0 \leqq i \leqq 128$. The frequency response of the denominator is found by 256-point FFT for a domain from 0 to $\pi$ for 1, $\alpha_1\lambda a$, $\alpha_2\lambda a^2$, . . . , $\alpha_P$ $\lambda a^P$, 0, 0, . . . , 0 at 128 points to find $(re'^2[i]+im'^2[i])^{1/2}$, where $0 \leqq i \leqq 128$.

The frequency response of equation 23 may be found by $$w_0[i] = \frac{\sqrt{re^2[i] + im^2[i]}}{\sqrt{re'^2[i] + im'^2[i]}}$$

where $0 \leqq i \leqq 128$. This is found for each associated point of, for example, the 44-order vector, by the following method. More precisely, linear interpolation should be used. However, in the following example, the closest point is used instead.

That is, $\omega[i]=\omega_0[\mathrm{nint}(128i/L)]$, where $1 \leqq i \leqq L$. In the equation, nint(X) is a function which returns a value closest to X.

As for H, h(1), h(2), . . . h(L) are found by a similar method. That is:

$$H = \begin{bmatrix} h(1) & & & 0 \\ & h(2) & & \\ & & \ddots & \\ 0 & & & h(L) \end{bmatrix}$$

$$W = \begin{bmatrix} w(1) & & & 0 \\ & w(2) & & \\ & & \ddots & \\ 0 & & & w(L) \end{bmatrix} \tag{24}$$

$$WH = \begin{bmatrix} h(1)w(1) & & & 0 \\ & h(2)w(2) & & \\ & & \ddots & \\ 0 & & & h(L)w(L) \end{bmatrix}$$

As another example, H(z)W(z) is first found and the frequency response is then found for a decreasing number of times of FFT. That is, the denominator of equation (25):

$$H(z)W(z) = \frac{1}{1+\sum_{i=1}^{P}\alpha_i z^{-i}} \cdot \frac{1+\sum_{i=1}^{P}\alpha_i\lambda_b^i z^{-i}}{1+\sum_{i=1}^{P}\alpha_i\lambda_a^i z^{-i}} \tag{25}$$

is expanded to $$\left(1+\sum_{i=1}^{P}\alpha_i z^{-i}\right)\left(1+\sum_{i=1}^{P}\alpha_a^i\lambda_a^i z^{-i}\right) = 1+\sum_{i=1}^{2P}\beta_i z^{-i}$$

256-point data, for example, is produced by using a string of 1, $\beta_1$, $\beta_2$, . . . , $\beta_{2P}$, 0, 0, . . . , 0. Then, 256-point FFT is performed, with the frequency response of the amplitude being $$rms[i] = \sqrt{re''^2[i] + im''^2[i]}$$

where $0 \leqq i \leqq 128$. From this, $$wh_0[i] = \frac{\sqrt{re^2[i] + im^2[i]}}{\sqrt{re''^2[i] + im''^2[i]}}$$

where $0 \leqq i \leqq 128$. This is found for each of the corresponding points of the L-dimensional vector. If the number of points of the FFT is small, linear interpolation should be used. The closest value herein, however, is found by:

$$wh[i] = wh_0\left[nint\left(\frac{128}{L}\cdot i\right)\right]$$

where $1 \leqq i \leqq L$. If a matrix having these as diagonal elements is W', $$W' = \begin{bmatrix} wh(1) & & & & 0 \\ & wh(2) & & & \\ & & \cdot & & \\ & & & \cdot & \\ & & & & \cdot \\ 0 & & & & wh(L) \end{bmatrix} \tag{26}$$

Equation (26) represents the same matrix as equation (24).

Alternatively, $|H(\exp(j\omega))W(\exp(j\omega))|$ may directly be found from equation (25) with respect to $\omega = i/L\lambda$ so as to be used for wh[i]. Still alternatively, an impulse response of the equation (25) is found for a suitable length, such as for 64 points, and FFTed to find amplitude frequency characteristics which may then be used for wh[i].

Rewriting equation (21) using this matrix, which is the frequency response of the weighted synthesis filter, we obtain equation (27):

$$E = \|W'(\underline{x} - g_1((\underline{s}_{0i} + \underline{s}_{1j}))\|^2 \tag{27}$$

The method for learning the shape codebook and the gain codebook will now be explained.

The expected value of the distortion is minimized for all frames k for which a code vector $s_{0c}$ is selected for CB0. If there are M such frames, it suffices if $$J = \frac{1}{M}\sum_{k=1}^{M}\|W_k'(\underline{x}_k - g_k(\underline{s}_{0c} + \underline{s}_{1k}))\|^2 \tag{28}$$

is minimized. In equation (28), $W_k'$, $\underline{X}_k$, $\underline{g}_k$ and $s_{1k}$ denote the weighting for the k'th frame, an input to the k'th frame, the gain of the k'th frame and an output of the codebook CB0 for the k'th frame, respectively.

Minimizing equation (28) results in:

$$\begin{aligned} J &= \frac{1}{M}\sum_{k=1}^{M}\{(\underline{x}_k^T - g_k(\underline{s}_{0c}^T + \underline{s}_{1k}^T))W_k'^T W_k'(\underline{x}_k - g_k(\underline{s}_{0c} + \underline{s}_{1k}))\} \\ &= \frac{1}{M}\sum_{k=1}^{M}\{\underline{x}_k^T W_k'^T W_k'\underline{x}_k - 2g_k(\underline{s}_{0c}^T + \underline{s}_{1k}^T)W_k'^T W_k'\underline{x}_k + \\ &\quad g_k^2(\underline{s}_{0c}^T + \underline{s}_{1k}^T)W_k'^T W_k'(\underline{s}_{0c} + \underline{s}_{1k})\} \\ &= \frac{1}{M}\sum_{k=1}^{M}\{\underline{x}_k^T W_k'^T W_k'\underline{x}_k - 2g_k(\underline{s}_{0c}^T + \underline{s}_{1k}^T)W_k'^T W_k'\underline{x}_k + \\ &\quad g_k^2\underline{s}_{0c}^T W_k'^T W_k'\underline{s}_{0c} + 2g_k^2\underline{s}_{0c}^T W_k'^T W_k'\underline{s}_{1k} + \\ &\quad g_k^2\underline{s}_{1k}^T W_k'^T W_k'\underline{s}_{1k}\} \end{aligned} \tag{29}$$

$$\frac{\partial J}{\partial \underline{s}_{0c}} = \frac{1}{M}\sum_{k=1}^{M}\{-2g_k W_k'^T W_k'\underline{x}_k + 2g_k^2 W_k'^T W_k'\underline{s}_{0c} + 2g_k^2 W_k'^T W_k'\underline{s}_{1k}\} = 0 \tag{30}$$

Hence, $$\sum_{k=1}^{M}(g_k W_k'^T W_k'\underline{x}_k - g_k^2 W_k'^T W_k'\underline{s}_{1k}) = \sum_{k=1}^{M} g_k^2 W_k'^T W_k'\underline{s}_{0c} \tag{31}$$

so that $$s_{0c} = \left\{\sum_{k=1}^{M} g_k^2 W_k'^T W_k'\right\}^{-1} \cdot \left\{\sum_{k=1}^{M} g_k W_k'^T W_k'(\underline{x}_k - g_k\underline{s}_{1k})\right\}$$

where $\{\ \}^{-1}$ denotes an inverse matrix and $W_k'^T$ denotes a transposed matrix of $W_k'$.

Next, gain optimization is considered.

The expected value of the distortion concerning the k'th frame selecting the code word $g_c$ of the gain is given by:

$$\begin{aligned} J_g &= \frac{1}{M}\sum_{k=1}^{N}\|W_k'(\underline{x}_k - g_c(\underline{s}_{0k} + \underline{s}_{1k}))\|^2 \\ &= \frac{1}{M}\sum_{k=1}^{M}\{\underline{x}_k^T W_k'^T W_k'\underline{x}_k - 2g_c\underline{x}_k^T W_k'^T W_k'(\underline{s}_{0k} + \underline{s}_{1k}) - \\ &\quad g_c^2(\underline{s}_{0k}^T + \underline{s}_{1k}^T)W_k'^T W_k'(\underline{s}_{0k} + \underline{s}_{1k})\} \end{aligned} \tag{32}$$

Solving $$\begin{aligned} \frac{\partial J_g}{\partial g_c} &= \frac{1}{M}\sum_{k=1}^{M}\{-2\underline{x}_k^T W_k'^T W_k'(\underline{s}_{0k} + \underline{s}_{1k}) - \\ &\quad 2g_c(\underline{s}_{0k}^T + \underline{s}_{1k}^T)W_k'^T W_k'(\underline{s}_{0k} + \underline{s}_{1k})\} = 0 \end{aligned}$$

we obtain $$\sum_{k=1}^{M}\underline{x}_k^T W_k'^T W_k'(\underline{s}_{0k} + \underline{s}_{1k}) = \sum_{k=1}^{M} g_c(\underline{s}_{0k}^T + \underline{s}_{1k}^T)W_k'^T W'(\underline{s}_{0k} + \underline{s}_{1k})$$

and $$g_c = \frac{\sum_{k=1}^{M}\underline{x}_k^T W_k'^T W_k'(\underline{s}_{0k} + \underline{s}_{1k})}{\sum_{k=1}^{M}(\underline{s}_{0k}^T + \underline{s}_{1k}^T)W_k'^T W'(\underline{s}_{0k} + \underline{s}_{1k})}$$

The above equations (31) and (32) give optimum centroid conditions for the shape $\underline{s}_{0i}$, $\underline{s}_{1j}$, and the gain $\underline{g}_i$ for $0 \leqq i \leqq 31$, which is an optimum decoder output. Meanwhile, $\underline{s}_{1j}$ may be found in the same way as for $\underline{s}_{0i}$.

The optimum encoding condition, that is, the nearest neighbor condition, is considered.

The above equation (27) for finding the distortion measure, which is $\underline{s}_{0i}$ and $\underline{s}_{1j}$ minimizing the equation $E = \|W'(x = -\underline{g}_c(\underline{s}_{0i} + \underline{s}_{1j}))\|^2$, are found each time the input x and the weight matrix W' are given, that is, on the frame-by-frame basis.

Intrinsically, E is found in a round robin fashion for all combinations of $g_1$ ($0 \leqq 1 \leqq 31$), $\underline{s}_{0i}$ ($0 \leqq i \leqq 31$) and $\underline{s}_{1j}$ ($0 \leqq j \leqq 31$), that is, 32×32×32=32768, in order to find the set of $\underline{s}_{0i}$, $\underline{s}_{1j}$ which will give the minimum value of E. However, since this requires voluminous calculations, the shape and the gain are sequentially searched in the present embodiment. Meanwhile, a round robin search is used for the combination of $s_{0i}$ and $\underline{s}_{1j}$. There are 32×32=1024 combinations for $s_{0i}$ and $\underline{s}_{1j}$. In the following description, $\underline{s}_{0i}+\underline{s}_{1j}$ are indicated as $\underline{s}_{717\ m}$ for simplicity.

The above equation (27) becomes $E=\mathbf{81}\ W'(x-g_1 s_m)\|^2$. If, for further simplicity, $X_k=W'x$ and $\underline{s}_w=W'\underline{s}_m$, we obtain $$E = \|\underline{x}_k - g_1 \underline{s}_w\|^2 \tag{33}$$

$$E = \|\underline{x}_w\|^2 + \|\underline{s}_w\|^2 \left( g_l - \frac{\underline{x}_w{}^T \cdot \underline{s}_w}{\|\underline{s}_w\|^2} \right) - \frac{(\underline{x}_w{}^T \cdot \underline{s}_w)}{\|\underline{s}_w\|^2} \tag{34}$$

Therefore, if $g_1$ can be made sufficiently accurate, search can be performed in the two steps of (1) searching for $\underline{s}_w$ that will maximize $$\frac{(\underline{x}_w{}^T \cdot \underline{s}_w)^2}{\|\underline{s}_w\|^2}$$

and (2) searching for $g_1$ which is closest to $$\frac{\underline{x}_w{}^T \cdot \underline{s}_w}{\|\underline{s}_w\|^2}.$$

If the above is rewritten using the original notation, (1)' searching is made for a set of $\underline{s}_{0i}$ and $\underline{s}_{1j}$ that will maximize $$\frac{(\underline{x}^T W^T W(\underline{s}_{0i} + \underline{s}_{1j}))^2}{\|W(\underline{s}_{0i} + \underline{s}_{1j})\|^2}$$

and (2)' searching is made for $g_1$ which is closest to $$\frac{(\underline{x}^T W^T W(\underline{s}_{0i} + \underline{s}_{1j}))^2}{\|W(\underline{s}_{0i} + \underline{s}_{1j})\|^2} \tag{35}$$

The above equation (35) represents an optimum encoding condition (nearest neighbor condition).

Using the conditions (centroid conditions) of equations (31) and (32) and the condition of equation (35), codebook learning of codebooks (CB0, CB1, and CBg) can be performed simultaneously by use of the so-called generalized Lloyd algorithm (GLA).

In the present embodiment, W' divided by a norm of an input x is used as W'. That is, $W'/\|x\|$ is substituted for W' in equations (31), (32), and (35).

Alternatively, the weighting W', used for perceptual weighting at the time of vector quantization by the vector quantizer 116, is defined by the above equation (26). However, the weighting W' that takes into account temporal masking can also be found by finding the current weighting W' in which past W' has been taken into account.

The values of wh(1), wh(2), . . . , wh(L) in the above equation (26), that are found at time n, that is, at the n'th frame, are indicated as whn(1), whn(2), . . . , whn(L), respectively.

If the weights at time n, taking past values into account, are defined as An(i), where $1 \leqq i \leqq L$, $$\begin{aligned} An(i) &= \lambda A_{n-1}(i) + (1-\lambda) whn(i), \ (whn(i) \leqq A_{n-1}(i)) \\ &= whn(i), \ (whn(i) > A_{n-1}(i)) \end{aligned}$$

where λ may be set to, for example, λ=0.2. In An(i), with $1 \leqq i \leqq L$, thus found, a matrix having such An(i) as diagonal elements may be used as the above weighting.

The shape index values $\underline{s}_{0i}$, $\underline{s}_{1j}$, obtained by the weighted vector quantization in this manner, are outputted at output terminals 520, 522, respectively, while the gain index $g_1$ is outputted at an output terminal 521. Also, the quantized value $x_0'$ is outputted at the output terminal 504, while being sent to the adder 505.

The adder 505 subtracts the quantized value from the spectral envelope vector x to generate a quantization error vector y. Specifically, this quantization error vector y is sent to the vector quantization unit 511 so as to be dimensionally split and quantized by vector quantizers $\mathbf{511}_1$ to $\mathbf{511}_8$ by weighted vector quantization.

The second vector quantization unit 510 uses a larger number of bits than the first vector quantization unit 500. Consequently, the memory capacity of the codebook and the processing volume (complexity) for codebook searching are increased significantly. Thus it becomes impossible to carry out vector quantization of the 44-order, which is the same as that of the first vector quantization unit 500. Therefore, the vector quantization unit 511 in the second vector quantization unit 510 is made up of a plurality of vector quantizers and the input quantized values are dimensionally split into a plurality of low-dimensional vectors for performing weighted vector quantization.

The relation between the quantized values $y_0$ to $y_7$, used in the vector quantizers $\mathbf{511}_1$ to $\mathbf{511}_8$, the number of dimensions, and the number of bits are shown in Table 2.

TABLE 2

| quantized value | dimension | number of bits |
|---|---|---|
| $\underline{y}_0$ | 4 | 10 |
| $\underline{y}_1$ | 4 | 10 |
| $\underline{y}_2$ | 4 | 10 |
| $\underline{y}_3$ | 4 | 10 |
| $\underline{y}_4$ | 4 | 9 |
| $\underline{y}_5$ | 8 | 8 |
| $\underline{y}_6$ | 8 | 8 |
| $\underline{y}_7$ | 8 | 7 |

The index values $Id_{vq0}$ to $Id_{vq7}$ outputted from the vector quantizers $\mathbf{511}_1$ to $\mathbf{511}_8$ are output at terminals $\mathbf{523}_1$ to $\mathbf{523}_8$. The sum of bits of these index data is 72.

If a value obtained by connecting the output quantized values $y_0'$ to $y_7'$ of the vector quantizers $\mathbf{511}_1$ to $\mathbf{511}_8$ in the dimensional direction is y', the quantized values y' and $x_0'$ are summed by the adder 513 to give a quantized value $x_1'$. Therefore, the quantized value $x_1'$ is represented by $$x_1' = x_0' + y' = x - y + y'$$

That is, the ultimate quantization error vector is y'-y.

If the quantized value $x_1'$ from the second vector quantizer 510 is to be decoded, the speech signal decoding apparatus does not need the quantized value $x_1'$ from the first quantization unit 500. It, however, does need index data from the first quantization unit 500 and the second quantization unit 510.

The learning method and code book search in the vector quantization section 511 will now be explained.

In the learning method, the quantization error vector y is divided into eight low-order vectors $y_0$ to $y_7$, using the weight W', as shown in Table 2. If the weight W' is a matrix having 44-point sub-sampled values as diagonal elements:

$$W' = \begin{bmatrix} wh(1) & & & & 0 \\ & wh(2) & & & \\ & & \cdot & & \\ & & & \cdot & \\ & & & & \cdot \\ 0 & & & & wh(44) \end{bmatrix} \tag{36}$$

the weight W' is split into the following eight matrices:

$$W_1' = \begin{bmatrix} wh(1) & & & & 0 \\ & \cdot & & & \\ & & \cdot & & \\ & & & \cdot & \\ 0 & & & & wh(4) \end{bmatrix}$$

$$W_2' = \begin{bmatrix} wh(5) & & & & 0 \\ & \cdot & & & \\ & & \cdot & & \\ & & & \cdot & \\ 0 & & & & wh(8) \end{bmatrix}$$

$$W_3' = \begin{bmatrix} wh(9) & & & & 0 \\ & \cdot & & & \\ & & \cdot & & \\ & & & \cdot & \\ 0 & & & & wh(12) \end{bmatrix}$$

$$W_4' = \begin{bmatrix} wh(13) & & & & 0 \\ & \cdot & & & \\ & & \cdot & & \\ & & & \cdot & \\ 0 & & & & wh(16) \end{bmatrix}$$

$$W_5' = \begin{bmatrix} wh(17) & & & & 0 \\ & \cdot & & & \\ & & \cdot & & \\ & & & \cdot & \\ 0 & & & & wh(20) \end{bmatrix}$$

$$W_6' = \begin{bmatrix} wh(21) & & & & 0 \\ & \cdot & & & \\ & & \cdot & & \\ & & & \cdot & \\ 0 & & & & wh(28) \end{bmatrix}$$

$$W_7' = \begin{bmatrix} wh(29) & & & & 0 \\ & \cdot & & & \\ & & \cdot & & \\ & & & \cdot & \\ 0 & & & & wh(36) \end{bmatrix}$$

$$W_8' = \begin{bmatrix} wh(37) & & & & 0 \\ & \cdot & & & \\ & & \cdot & & \\ & & & \cdot & \\ 0 & & & & wh(44) \end{bmatrix}$$

Note that y and W', thus split into lower dimensions, are termed $y_i$ and $W_I'$, where $1 \leqq i \leqq 8$, respectively.

The distortion measure E is defined as $$E = \|W_I'(y_i - s)\|^2 \tag{37}$$

The codebook vector s is the result of quantization of $y_i$. Such a code vector of the codebook that minimizes the distortion measure E is searched.

In codebook learning, further weighting is done using the general Lloyd algorithm (GLA). The optimum centroid condition for learning will now be explained.

If there are M input vectors y which have selected the code vector s as the optimum quantization result, and the learning data is $y_k$, the expected value of distortion J is given by equation (38) minimizing the center of distortion on weighting with respect to all frames k:

$$\begin{aligned} J &= \frac{1}{M}\sum_{k-1}^{M} \|W_k'(\underline{y}_k - \underline{s})\|^2 \\ &= \frac{1}{M}\sum_{k-1}^{M} (\underline{y}_k - \underline{s})^T W_k'^T W_k'(\underline{y}_k - \underline{s}) \\ &= \frac{1}{M}\sum_{k-1}^{M} \underline{y}_k^T W_k'^T W_k' \underline{y}_k - 2\underline{y}_k^T W_k'^T W_k' \underline{s} + \\ &\quad \underline{s}^T W_k'^T W_k' \underline{s} \\ \frac{\partial J}{\partial \underline{s}} &= \frac{1}{M}\sum_{k-1}^{M} (-2\underline{y}_k^T W_k'^T W_k' + 2\underline{s}^T W_k'^T W_k') = 0 \end{aligned} \tag{38}$$

Solving, we obtain $$\sum_{k-1}^{M} \underline{y}_k^T W_k'^T W_k' = \sum_{k-1}^{M} \underline{s}^T W_k'^T W_k'.$$

Taking transposed values of both sides, we obtain $$\sum_{k=1}^{M} W_k'^T W_k' \underline{y}_k = \sum_{k=1}^{M} W_k' W_k' \underline{s}. \tag{39}$$

Therefore, $$\underline{s} = \left(\sum_{k=1}^{M} W_k'^T W_k'\right)^{-1} \sum_{k=1}^{M} W_k'^T W_k' \underline{y}_k.$$

In the above equation (39), s is an optimum representative vector and represents an optimum centroid condition.

As for the optimum encoding condition, it suffices to search for s minimizing the value of $\|W_I'(y_i - s)\|^2$. $W_I'$ during searching need not be the same as $W_I'$ during learning and may be the non-weighted matrix:

$$\begin{bmatrix} 1 & & & & 0 \\ & 1 & & & \\ & & \cdot & & \\ & & & \cdot & \\ & & & & \cdot \\ 0 & & & & 1 \end{bmatrix}$$

By constituting the vector quantization unit 116 in the speech signal encoder with two-stage vector quantization units, it becomes possible to render the number of output index bits variable.

Figure 9:
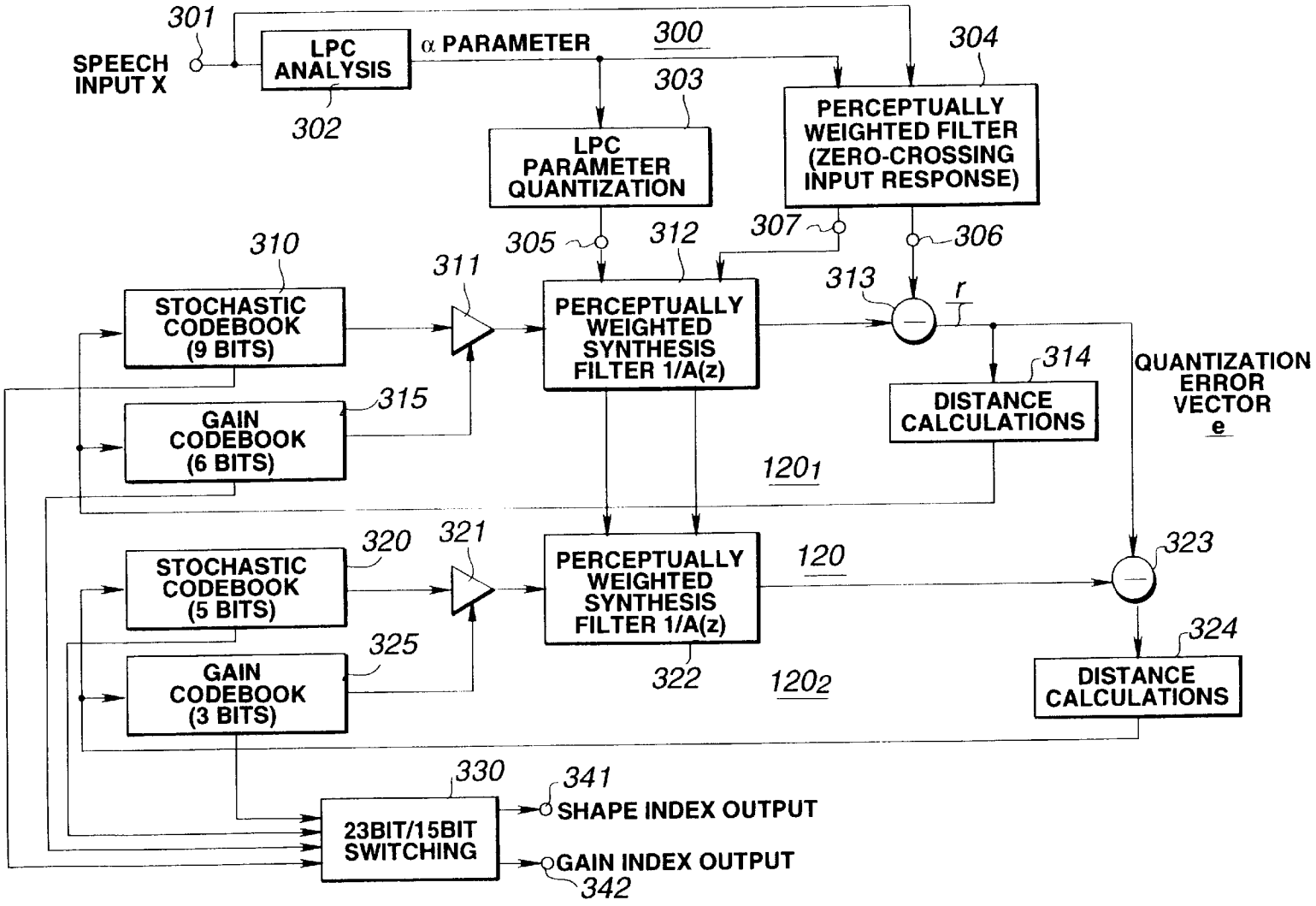
FIG. 9 is a block circuit diagram showing a detailed structure of a CELP encoding portion (second encoding unit) of the speech signal encoder of the present invention.

The second encoding unit 120 employing the above-mentioned CELP encoder of the present invention, is comprised of multi-stage vector quantization processors as shown in FIG. 9. These multi-stage vector quantization processors are formed as two-stage encoding units $\mathbf{120}_1$, $\mathbf{120}_2$ are shown in the embodiment of FIG. 9, in which an arrangement for coping with the transmission bit rate of 6 kbps in case the transmission bit rate can be switched between, for example, 2 kbps and 6 kbps. In addition, the shape and gain index output can be switched between 23 bits/5 msec and 15 bits/5 msec. The processing flow in the arrangement of FIG. 9 is shown in FIG. 10.

Referring to FIG. 9, an LPC analysis circuit 302 corresponds to the LPC analysis circuit 132 shown in FIG. 3, while an LSP parameter quantization circuit 303 corresponds to the α-to-LSP conversion circuit 133 to the LSP-to-α conversion circuit 137 of FIG. 3, and a perceptually weighted filter 304 corresponds to the perceptual weighting filter calculation circuit 139 and the perceptually weighted filter 125 of FIG. 3. Therefore, in FIG. 9, an output which is the same as that from the LSP-to-α conversion circuit 137 of the first encoding unit 113 of FIG. 3 is supplied to a terminal 305, while an output which is the same as the output from the perceptually weighted filter calculation circuit 139 of FIG. 3 is supplied to a terminal 307 and an output which is the same as the output from the perceptually weighted filter 125 of FIG. 3 is supplied to a terminal 306. Distinct from the perceptually weighted filter 125, however, the perceptually weighted filter 304 of FIG. 9 generates the perceptually weighed signal, that is, the same signal as the output from the perceptually weighted filter 125 of FIG. 3, using the input speech data and pre-quantization α-parameter instead of using an output from the LSP-α conversion circuit 137.

In the two-stage second encoding units $\mathbf{120}_1$ and $\mathbf{120}_2$, shown in FIG. 9, subtractors 313 and 323 correspond to the subtractor 123 of FIG. 3, while the distance calculation circuits 314, 324 correspond to the distance calculation circuit 124 of FIG. 3. In addition, the gain circuits 311, 321 correspond to the gain circuit 126 of FIG. 3, while stochastic codebooks 310, 320 and gain codebooks 315, 325 correspond to the noise codebook 121 of FIG. 3.

Figure 10:
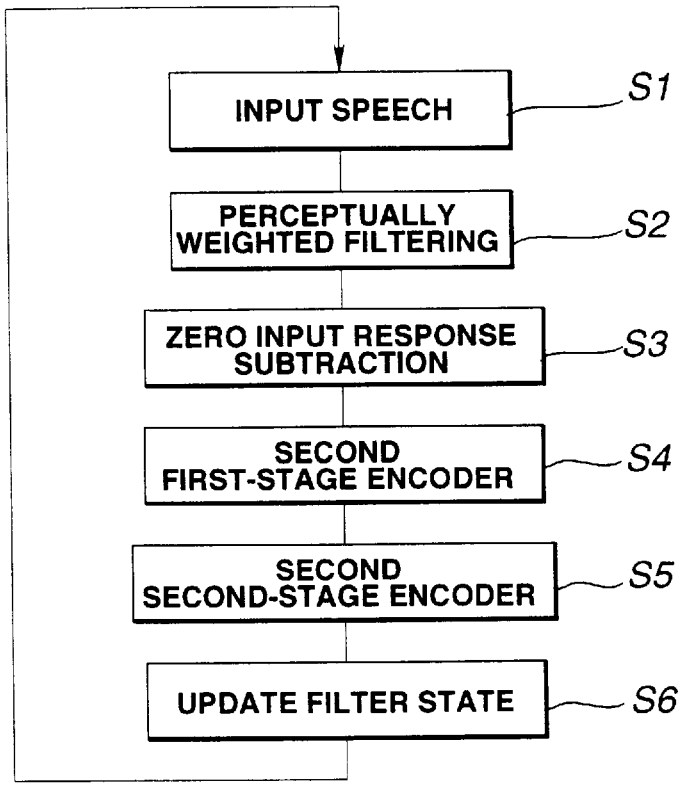
FIG. 10 is a flow chart for illustrating the processing flow in the arrangement of FIG. 9.

In the constitution of FIG. 9, the LPC analysis circuit 302 at step S1 of FIG. 10 splits input speech data x supplied from a terminal 301 into frames as described above to perform LPC analysis in order to find an α-parameter. The LSP parameter quantization circuit 303 converts the α-parameter from the LPC analysis circuit 302 into LSP parameters to quantize the LSP parameters. The quantized LSP parameters are interpolated and converted into α-parameters. The LSP parameter quantization circuit 303 generates an LPC synthesis filter function 1/H(z) from the α-parameters converted from the quantized LSP parameters, that is, the quantized LSP parameters, and sends the generated LPC synthesis filter function 1/H(z) to a perceptually weighted synthesis filter 312 of the first-stage second encoding unit $\mathbf{120}_1$ via terminal 305.

The perceptual weighting filter 304 finds data for perceptual weighting, which is the same as that produced by the perceptually weighting filter calculation circuit 139 of FIG. 3, from the α-parameter from the LPC analysis circuit 302, that is, the pre-quantization α-parameter. These weighting data are supplied via terminal 307 to the perceptually weighting synthesis filter 312 of the first-stage second encoding unit $\mathbf{120}_1$. The perceptual weighting filter 304 generates the perceptually weighted signal, which is the same signal as that output by the perceptually weighted filter 125 of FIG. 3, from the input speech data and the pre-quantization α-parameter, as shown at step S2 in FIG. 10. That is, the LPC synthesis filter function W(z) is first generated from the pre-quantization α-parameter. The filter function W(z) thus generated is applied to the input speech data x to generate $X_k$ which is supplied as the perceptually weighted signal via terminal 306 to the subtractor 303 of the first-stage second encoding unit $\mathbf{120}_1$.

In the first-stage second encoding unit $\mathbf{120}_1$, a representative value output of the stochastic codebook 310 of the 9-bit shape index output is sent to the gain circuit 311 which then multiplies the representative output from the stochastic codebook 310 with the gain (scalar) from the gain codebook 315 of the 6-bit gain index output. The representative value output, multiplied with the gain from the gain circuit 311, is sent to the perceptually weighted synthesis filter 312 with 1/A(z)=(1/H(z))*W(z). The weighting synthesis filter 312 sends the 1/A(z) zero-input response output to the subtractor 313, as indicated at step S3 of FIG. 10. The subtractor 313 performs subtraction on the zero-input response output of the perceptually weighted synthesis filter 312 and the perceptually weighted signal $X_k$ from the perceptually weighted filter 304 and the resulting difference or error is extracted as a reference vector r. During searching at the first-stage second encoding unit $\mathbf{120}_1$, this reference vector r is sent to the distance calculating circuit 314 where the distance is calculated and the shape vector s and the gain g minimizing the quantization error energy E are searched for, as shown at step S4 in FIG. 10. Here, 1/A(z) is in the zero state. That is, if the shape vector s in the codebook synthesized with 1/A(z) in the zero state is $s_{syn}$, the shape vector s and the gain g minimizing equation (40):

$$E = \sum_{n=0}^{N-1} (r(n) - g\underline{s}_{syn}(n))^2 \tag{40}$$

are searched.

Although s and g minimizing the quantization error energy E may be full-searched, the following method may be used for reducing the amount of calculations.

The first method is to search the shape vector s minimizing $E_s$ defined by the following equation (41):

$$E_s = \frac{\sum_{n=0}^{N-1} r(n)\underline{s}_{syn}(n)}{\sqrt{\sum_{n=0}^{N-1} \underline{s}_{syn}(n)^2}}$$

From s obtained by the first method, the ideal gain is shown by equation (42):

$$g_{ref} = \frac{\sum_{n=0}^{N-1} r(n)\underline{s}_{syn}(n)}{\sqrt{\sum_{n=0}^{N-1} \underline{s}_{syn}(n)^2}} \tag{42}$$

Therefore, as the second method, such g minimizing equation (43):

$$E_g = (g_{ref} - g)^2 \tag{43}$$

is searched. Since E is a quadratic function of g, such g minimizing $E_g$ minimizes E.

From s and g obtained by the first and second methods, the quantization error vector e can be calculated by the following equation (44):

$$e = r - gs_{syn} \tag{44}$$

This is quantized as a reference of the second-stage second encoding unit $\mathbf{120}_2$ as in the first stage.

That is, the signal supplied to the terminals 305 and 307 are directly supplied from the perceptually weighted synthesis filter 312 of the first-stage second encoding unit $\mathbf{120}_1$ to a perceptually weighted synthesis filter 322 of the second-stage second encoding unit $\mathbf{120}_2$. The quantization error vector e found by the first-stage second encoding unit $\mathbf{120}_1$ is supplied to a subtractor 323 of the second-stage second encoding unit $\mathbf{120}_2$.

At step S5 of FIG. 10, processing similar to that performed in the first stage occurs in the second-stage second encoding unit $\mathbf{120}_2$. That is, a representative value output from the stochastic codebook 320 of the 5-bit shape index output is sent to the gain circuit 321 where the representative value output of the codebook 320 is multiplied with the gain from the gain codebook 325 of the 3-bit gain index output. An output of the weighted synthesis filter 322 is sent to the subtractor 323 where a difference between the output of the perceptually weighted synthesis filter 322 and the first-stage quantization error vector e is found. This difference is sent to a distance calculation circuit 324 for distance calculation in order to search the shape vector s and the gain g minimizing the quantization error energy E.

The shape index output of the stochastic codebook 310 and the gain index output of the gain codebook 315 of the first-stage second encoding unit $\mathbf{120}_1$ and the index output of the stochastic codebook 320 and the index output of the gain codebook 325 of the second-stage second encoding unit $\mathbf{120}_2$ are sent to an index output switching circuit 330. If 23 bits are outputted from the second encoding unit 120, the index data of the stochastic codebooks 310, 320 and the gain codebooks 315, 325 of the first-stage and second-stage second encoding units $\mathbf{120}_1$, $\mathbf{120}_2$ are summed and output. If 15 bits are output, the index data of the stochastic codebook 310 and the gain codebook 315 of the first-stage second encoding unit $\mathbf{120}_1$ are output. The filter state is then updated for calculating zero input response output as shown at step S6.

In the present embodiment, the number of index bits of the second-stage second encoding unit $\mathbf{120}_2$ is as small as 5 for the shape vector, while that for the gain is as small as 3. If suitable shape and gain are not present in this case in the codebook, the quantization error is likely to be increased, instead of being decreased.

Although 0 may be provided in the gain for preventing such defect, there are only three bits for the gain. if one of these is set to 0, the quantizer performance is significantly deteriorated. In this consideration, an all-0 vector is provided for the shape vector to which a larger number of bits have been allocated. The above-mentioned search is performed, with the exclusion of the all-zero vector, and the all-zero vector is selected if the quantization error has ultimately been increased. The gain is arbitrary. This makes it possible to prevent the quantization error from being increased in the second-stage second encoding unit $\mathbf{120}_2$.

Although the two-stage arrangement has been described above, the number of stages may be larger than 2. In such a case, if the vector quantization by the first-stage closed-loop search has come to a close, quantization of the N'th stage, where $2 \leqq N$, is carried out with the quantization error of the (N−1)'th stage used as a reference input, and the quantization error of the N'th stage is used as a reference input to the (N+1)'th stage.

It is seen from FIGS. 9 and 10 that, by employing multi-stage vector quantizers for the second encoding unit, the amount of calculations is decreased as compared to that when using a straight vector quantization with the same number of bits or when using a conjugate codebook. In particular, in CELP encoding in which vector quantization of the time-axis waveform employing the closed-loop search by the analysis-by-synthesis method, use of a smaller number of search operations is crucial. In addition, the number of bits can be easily switched by switching between employing both index outputs of the two-stage second encoding units $\mathbf{120}_1$, $\mathbf{120}_2$ and employing only the output of the first-stage second encoding unit 120 without employing the output of the second-stage second encoding unit $\mathbf{120}_1$. If the index outputs of the first-stage and second-stage second encoding units $\mathbf{120}_1$, $\mathbf{120}_2$ are combined and output, the decoder can easily cope with the configuration by selecting one of the index outputs. That is, the decoder can easily cope with the configuration by decoding the parameter encoded with, for example, 6 kbps using a decoder operating at 2 kbps. In addition, if a zero-vector is contained in the shape codebook of the second-stage second encoding unit $\mathbf{120}_2$, it becomes possible to prevent the quantization error from being increased with a smaller deterioration in performance than if 0 is added to the gain.

The code vector of the stochastic codebook, for example, can be generated by clipping the so-called Gaussian noise. Specifically, the codebook may be generated by generating the Gaussian noise, clipping the Gaussian noise with a suitable threshold value and normalizing the clipped Gaussian noise.

Figure 11A:
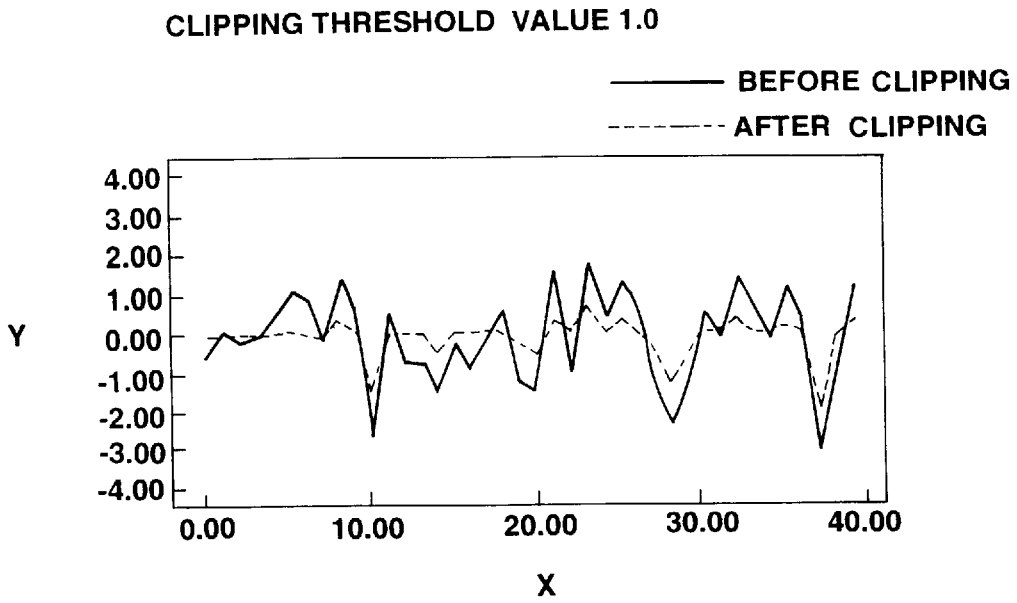
FIGS. 11A and 11B illustrate Gaussian noise after clipping at different threshold values.
Figure 11B:
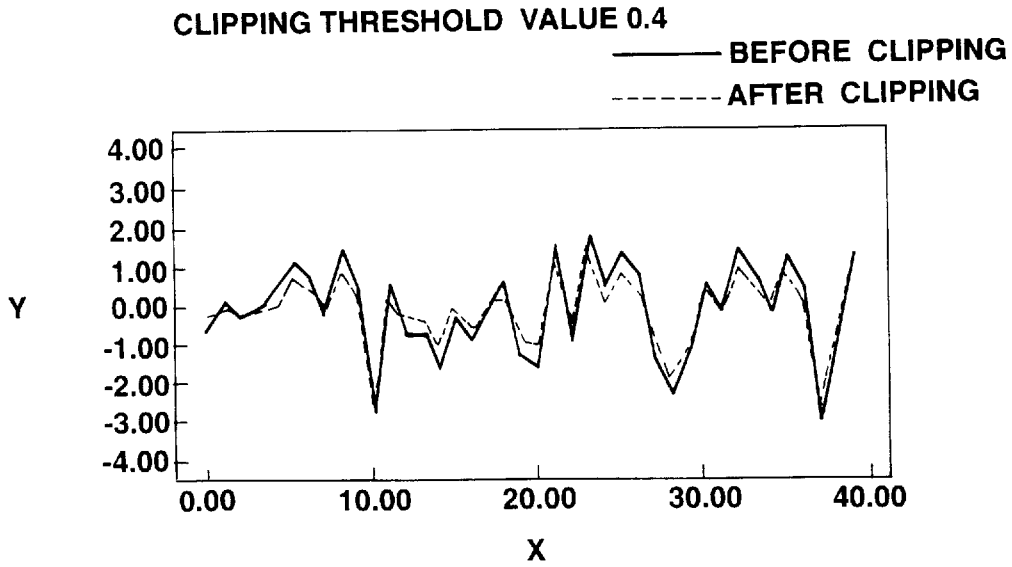

However, there are a variety of types of sounds in typical speech. For example, the Gaussian noise can cope with speech of consonant sounds close to noise, such as "sa," "shi," "su," "se," and "so," while the Gaussian noise cannot cope with the speech of acutely rising consonants, such as "pa," "pi," "pu," "pe," and "po." According to the present invention, the Gaussian noise is applied to some of the code vectors, while the remaining portion of the code vectors is dealt with by learning, so that both the consonants having sharply rising consonant sounds and the consonant sounds close to the noise can be coped with. If, for example, the threshold value is increased, a vector is obtained which has several larger peaks, whereas, if the threshold value is decreased, the code vector is approximate to the Gaussian noise. Thus, by increasing the variation in the clipping threshold value, it becomes possible to cope with consonants having sharp rising portions, such as "pa," "pi," "pu," "pe," and "po" or consonants close to noise, such as "sa," "shi," "su," "se," and "so," thereby increasing clarity. FIG. 11 shows the appearance of the Gaussian noise and the clipped noise by a solid line and by a broken line, respectively. FIGS. 11A and 11B show the noise with the clipping threshold value equal to 1.0, that is with a larger threshold value, and the noise with the clipping threshold value equal to 0.4, that is with a smaller threshold value. It is seen from FIGS. 11A and 11B that, if the threshold value is selected to be larger, there is obtained a vector having several larger peaks, whereas, if the threshold value is selected to be a smaller value, the noise approaches the Gaussian noise itself.

For realizing this, an initial codebook is prepared by clipping the Gaussian noise and a suitable number of non-learning code vectors are set. The non-learning code vectors are selected in the order of increasing variance value for coping with consonants close to the noise, such as "sa," "shi," "su," "se," and "so." The vectors found by learning use the LBG algorithm for learning. The encoding under the nearest neighbor condition uses both the fixed code vector and the code vector obtained from learning. In the centroid condition, only the code vector set for learning is updated. Thus the code vector set for learning can cope with sharply rising consonants, such as "pa," "pi," "pu," "pe," and "po."

An optimum gain may be learned for these code vectors by usual learning.

Figure 12:
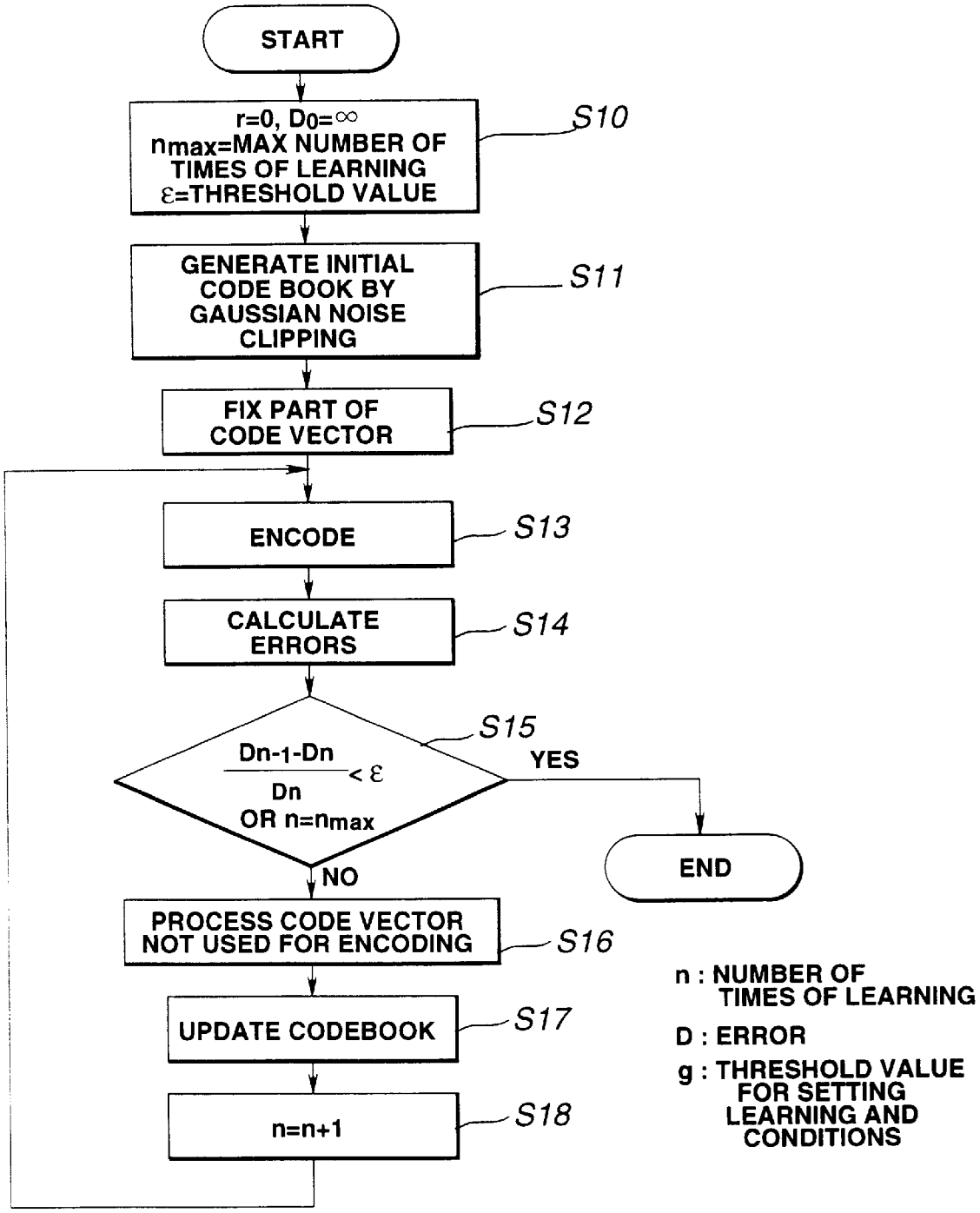
FIG. 12 is a flowchart showing the processing flow for generating the shape codebook by learning.

FIG. 12 shows the processing flow for the constitution of the codebook by clipping the Gaussian noise.

In FIG. 12, the number of times of learning n is set to n=0 at step S10 for initialization. With an error $D_0=\infty$, the maximum number of times of learning $n_{max}$ is set and a threshold value $\epsilon$ setting the learning end condition is set.

At the next step S11, the initial codebook is generated by clipping the Gaussian noise. At step S12, part of the code vectors is fixed as non-learning code vectors.

At the next step S13, encoding is done using the above codebook. At step S14, the error is calculated. At step S15, it is judged if $(D_{n-1}-D_n)/D_n<\epsilon$, or $n=n_{max}$. If the result is YES, processing is terminated. If the result is NO, processing transfers to step S16.

At step S16, the code vectors not used for encoding are processed. At the next step S17, the codebooks are updated. At step S18, the number of times of learning n is incremented before returning to step S13.

Figure 14:
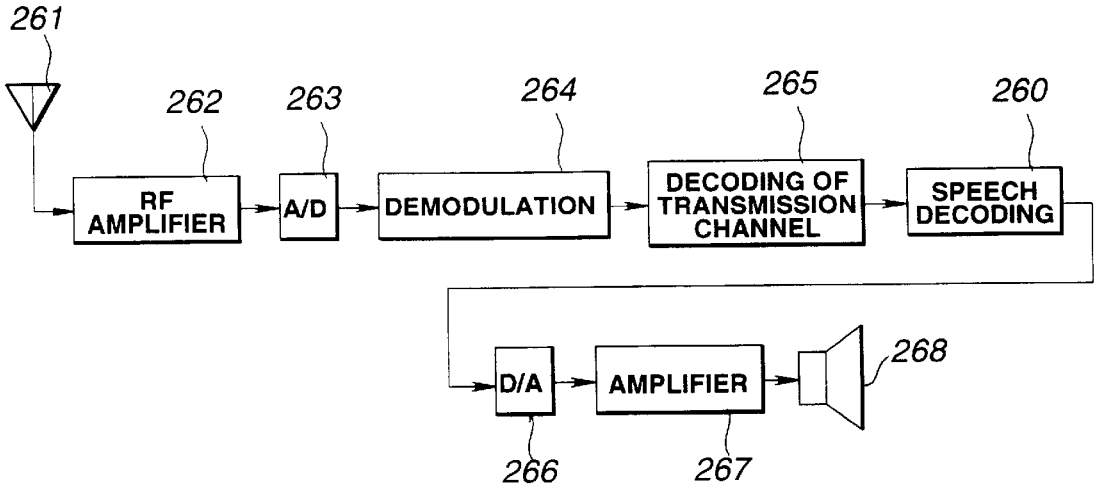
FIG. 14 is a block diagram showing a structure of a receiving side of the portable terminal employing a counterpart speech signal decoder to the device of FIG. 13.

The above-described signal encoding and signal decoding apparatus may be used as a speech codebook employed in, for example, a portable communication terminal or a portable telephone set shown in FIG. 14.

Figure 13:
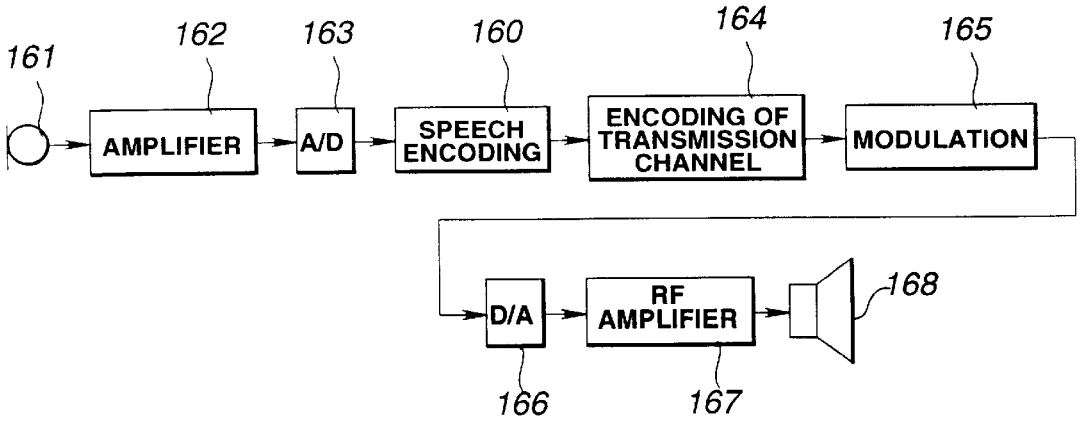
FIG. 13 is a block diagram showing a structure of a transmission side of a portable terminal employing a speech signal encoder embodiment of the present invention.

FIG. 13 shows a transmitting side of a portable terminal employing a speech encoding unit 160 configured as shown in FIGS. 1 and 3. The speech signals collected by a microphone 161 are amplified by an amplifier 162 and converted by an analog/digital (A/D) converter 163 into digital signals which are sent to the speech encoding unit 160 configured as shown in FIGS. 1 and 3. The digital signals from the A/D converter 163 are supplied to the input terminal 101. The speech encoding unit 160 performs encoding as explained in connection with FIGS. 1 and 3. Output signals of output terminals of FIGS. 1 and 2 are sent as output signals of the speech encoding unit 160 to a transmission channel encoding unit 164 which then performs channel coding on the supplied signals. Output signals of the transmission channel encoding unit 164 are sent to a modulation circuit 165 for modulation and thence supplied to an antenna 168 via a digital/analog (D/A) converter 166 and an RF amplifier 167.

FIG. 14 shows a reception side of a portable terminal employing a speech decoding unit 260 configured as shown in FIG. 4. The speech signals received by the antenna 261 of FIG. 14 are amplified an RF amplifier 262 and sent via an analog/digital (A/D) converter 263 to a demodulation circuit 264, from which demodulated signals are sent to a transmission channel decoding unit 265. An output signal of the decoding unit 265 is supplied to a speech decoding unit 260 configured as shown in FIGS. 2 and 4. The speech decoding unit 260 decodes the signals as explained in connection with FIGS. 2 and 4. An output signal at an output terminal 201 of FIGS. 2 and 4 is sent as a signal of the speech decoding unit 260 to a digital/analog (D/A) converter 266. An analog speech signal from the D/A converter 266 is sent to a speaker 268.

The present invention is not limited to the above-described embodiments. For example, the configuration of the speech synthesis side (encoder) or the speech synthesis side (decoder), so far described as hardware, can also be realized by a software program using a so-called digital signal processor (DSP). Also, data of a plurality of frames may be collected together and quantized by matrix quantization instead of by vector quantization. Moreover, the speech encoding method or a corresponding speech decoding method may also be applied not only to the speech synthesis/analysis method employing multi-band excitation described above but also to a variety of speech synthesis/analysis methods such as those synthesizing voiced portions of speech by sinusoidal synthesis and synthesizing the unvoiced speech portions based on noise signals. The invention may also be applied to wide fields of application. That is, the present invention is not limited to transmission or recording/reproduction but also may be applied to pitch conversion, speech modification, or noise suppression.

What is claimed is:

1. A speech signal encoding method comprising the steps of:

encoding a voiced portion of an input speech signal using a sinusoidal analysis technique; and encoding an unvoiced portion of said input speech signal using a code excitation linear prediction (CELP) technique, including dividing said input speech signal on a time axis into units of blocks; and encoding said divided input speech signal by vector quantization using a time-domain closed-loop search of an optimum vector based on an analysis-by-synthesis method, said optimum vector being a vector that minimizes an error between said input speech signal and an encoded speech signal, wherein said vector quantization of said divided input speech signal uses a codebook memory containing a first set of codebook vectors generated by clipping a Gaussian noise at a plurality of predetermined threshold values and a second set of codebook vectors generated by adaptively changing said first set of codebook vectors using said first set of codebook vectors as initial values.

2. The speech signal encoding method as claimed in claim 1, wherein said codebook memory used for said vector quantization includes a codebook vector having all zero elements.

3. A speech encoding apparatus for encoding an input speech signal divided on a time axis into units of blocks, the apparatus comprising:

first encoding means for encoding a voiced portion of an input speech signal using a sinusoidal analysis technique; and second encoding means for encoding an unvoiced portion of said input speech signal using a code excitation linear prediction (CELP) technique, wherein said second encoding means performs vector quantization of results of a time-domain closed-loop search of an optimum vector using an analysis-by-synthesis method, and said second encoding means includes a codebook memory containing codebook vectors for performing said vector quantization, said codebook vectors including a first set of codebook vectors generated by clipping a Gaussian noise at a plurality of predetermined threshold values and a second set of codebook vectors generated by adaptively changing said first set of vectors using said first set of codebook vectors as initial values.

4. A portable communication apparatus comprising:

amplifier means for amplifying an input speech signal;

A/D conversion means for performing analog to digital conversion of an amplified input speech signal from said amplifier means;

speech encoding means for speech-encoding an output of said A/D conversion means, including a first encoding section for encoding a voiced portion of an input speech signal using a sinusoidal analysis technique; and a second encoding section for encoding an unvoiced portion of said input speech signal using a code excitation linear prediction (CELP) technique;

transmission channel encoding means for channel-coding an output of said speech encoding means;

modulation means for modulating a signal from said transmission channel encoding means;

D/A conversion means for digital to analog conversion of a signal from said modulation means; and RF amplifier means for amplifying a signal from said D/A conversion means and supplying an output signal to an antenna, wherein said second encoding section includes means for performing vector quantization using a time-domain closed-loop search of an optimum vector based on an analysis-by-synthesis method, said optimum vector being a vector that minimizes an error between said input speech signal and an encoded speech signal and a codebook memory containing codebook vectors for performing said vector quantization, said codebook vectors including a first set of codebook vectors generated by clipping a Gaussian noise at a plurality of threshold values and a second set of codebook vectors generated by adaptively changing said first set of codebook vectors using said first set of codebook vectors as initial values.

5. A portable communication terminal apparatus comprising:

RF amplifier means for amplifying an input speech signal;

A/D conversion means for analog to digital conversion of an amplified input speech signal from said RF amplifier means;

demodulation means for demodulating an output from said A/D conversion means;

transmission channel decoding means for channel-decoding an output from said demodulation means;

speech decoding means for speech-decoding an output of said transmission channel decoding means, said speech decoding means decoding a signal encoded by a first encoding section, which encodes a voiced portion of an input speech signal using a sinusoidal analysis technique, and a second encoding section, which encodes an unvoiced portion of said input speech signal using a code excitation linear prediction (CELP) technique;

D/A conversion means for digital to analog conversion of a decoded signal from said speech decoding means; and amplifier means for amplifying an output signal from said D/A conversion means and supplying the amplified signal to a speaker, wherein said second encoding section performs vector quantization of results of a time-domain closed-loop search of an optimum vector using an analysis-by-synthesis method and a codebook memory containing a first set of codebook vectors generated by clipping a Gaussian noise at a plurality of threshold values and a second set of codebook vectors generated by adaptively changing said first set of codebook vectors using said first set of codebook vectors as initial values.

* * * * *